US009731508B2

(12) United States Patent
Zou et al.

(10) Patent No.: US 9,731,508 B2
(45) Date of Patent: Aug. 15, 2017

(54) LIQUID JET HEAD, METHOD FOR INTEGRALLY MANUFACTURING A LIQUID JET APPARATUS, AND DEVICE

(71) Applicants: DALIAN UNIVERSITY OF TECHNOLOGY, Dalian (CN); ZHUHAI SEINE TECHNOLOGY CO., LTD., Zhuhai (CN)

(72) Inventors: Helin Zou, Dalian (CN); Jingzhi He, Dalian (CN); Yue Li, Zhuhai (CN); Xiaokun Chen, Zhuhai (CN)

(73) Assignees: DALIAN UNIVERSITY OF TECHNOLOGY, Liaoning (CN); ZHUHAI SEINE TECHNOLOGY CO., LTD., Guangdong (CN)

( * ) Notice: Subject to any disclaimer, the term of this patent is extended or adjusted under 35 U.S.C. 154(b) by 11 days.

(21) Appl. No.: 15/073,594

(22) Filed: Mar. 17, 2016

(65) Prior Publication Data

US 2016/0200105 A1 Jul. 14, 2016

Related U.S. Application Data

(63) Continuation of application No. PCT/CN2014/089454, filed on Oct. 24, 2014.

(30) Foreign Application Priority Data

Dec. 26, 2013 (CN) ..... 2013 1 0733314
Apr. 29, 2014 (CN) ..... 2014 1 0182638

(51) Int. Cl.
*B41J 2/16* (2006.01)
*B41J 2/14* (2006.01)

(52) U.S. Cl.
CPC ..... *B41J 2/162* (2013.01); *B41J 2/1433* (2013.01); *B41J 2/161* (2013.01); *B41J 2/1623* (2013.01);

(Continued)

(58) Field of Classification Search
None
See application file for complete search history.

(56) References Cited

U.S. PATENT DOCUMENTS

2004/0021005 A1 2/2004 Stout et al. ..... 239/302
2005/0190232 A1* 9/2005 Lee ..... B41J 2/14137 347/45

(Continued)

FOREIGN PATENT DOCUMENTS

CN 1545451 A 11/2004
CN 1839046 A 9/2006

(Continued)

OTHER PUBLICATIONS

International Search Report of corresponding International PCT Application No. PCT/CN2014/089454, dated Jan. 23, 2015.

(Continued)

*Primary Examiner* — Lisa M Solomon
(74) *Attorney, Agent, or Firm* — J.C. Patents

(57) ABSTRACT

A liquid jet head manufacturing method, a method for integrally manufacturing a liquid jet apparatus, a liquid jet head, a printing apparatus and a liquid jet apparatus. The manufacturing method includes: forming multiple pressure-generating members arranged spaced apart on a first substrate; forming, on a first surface of first substrate, pressure chambers corresponding to multiple pressure-generating members, and a common chamber in communication with multiple pressure chambers; forming a transition layer on pressure chambers, and forming a jet orifice plate on transition layer; and forming, on jet orifice plate and transition layer, jet orifices in communication with pressure chambers. When the number of pressure chambers needs to be increased, since pressure chambers are formed on first substrate individually, mechanical strength of first substrate will not be reduced, and during manufacturing process, (Continued)

breakage of first substrate can be avoided, improving yield of liquid jet head, and reducing manufacturing cost.

12 Claims, 28 Drawing Sheets

(52) U.S. Cl.
CPC ..... *B41J 2/1626* (2013.01); *B41J 2/1628* (2013.01); *B41J 2/1629* (2013.01); *B41J 2/1631* (2013.01); *B41J 2/1642* (2013.01); *B41J 2/1646* (2013.01)

(56) References Cited

U.S. PATENT DOCUMENTS

| | | | | |
|---|---|---|---|---|
| 2006/0134561 | A1 | 6/2006 | Rosa et al. | 430/320 |
| 2009/0195605 | A1* | 8/2009 | Yanata | B41J 2/1433 347/47 |
| 2010/0212228 | A1 | 8/2010 | Chang et al. | 49/346 |

FOREIGN PATENT DOCUMENTS

| | | | |
|---|---|---|---|
| CN | 101003206 | A | 7/2007 |
| CN | 101491973 | A | 7/2009 |
| CN | 101505967 | A | 8/2009 |
| CN | 103085479 | A | 5/2013 |
| CN | 103182844 | A | 7/2013 |
| CN | 103192603 | A | 7/2013 |
| CN | 103770468 | A | 5/2014 |
| CN | 103935128 | A | 7/2014 |
| JP | 2009-196354 | A | 9/2009 |
| WO | WO 01/03934 | A1 | 1/2001 |

OTHER PUBLICATIONS

Chinese First Examination Report of corresponding China application No. 201410182638.1, dated Apr. 27, 2015.

* cited by examiner

LIQUID JET HEAD, METHOD FOR INTEGRALLY MANUFACTURING A LIQUID JET APPARATUS, AND DEVICE

CROSS-REFERENCE TO RELATED APPLICATIONS

This application is a continuation of International Application No. PCT/CN2014/089454, filed on Oct. 24, 2014, which claims priorities to Chinese Patent Application No. 201310733314.8, filed on Dec. 26, 2013, entitled "LIQUID JET APPARATUS AND INTEGRALLY MANUFACTURING METHOD THEREOF" and Chinese Patent Application No. 201410182638.1, filed on Apr. 29, 2014, entitled "LIQUID JET HEAD MANUFACTURING METHOD, LIQUID JET HEAD AND PRINTING APPARATUS", which are hereby incorporated by reference in their entireties.

TECHNICAL FIELD

The present invention relates to printer technologies, and more particularly, to a liquid jet head, a method for integrally manufacturing a liquid jet apparatus, and a device.

BACKGROUND

In terms of a liquid jet head or a liquid jet apparatus of a printer, deformation of a piezoelectric element and a vibrating plate causes a change in volume of a pressure chamber, so that ink in the pressure chamber jets from a jet orifice.

An existing liquid jet head includes a substrate, a vibrating plate and a piezoelectric element arranged on a first face of the substrate, and a jet orifice plate bonded on a second face (opposite to the first face) of the substrate. The existing liquid jet head is manufactured as follows: forming a vibrating plate and a piezoelectric element on a first face of a substrate, etching, by means of performing an etching process on a second face of the substrate, the substrate to form a plurality of pressure chambers for storing liquid corresponding to positions of piezoelectric elements and a common chamber corresponding to the position of an ink supply hole, and finally, bonding a jet orifice plate on the second face of the substrate, so that a plurality of jet orifices on the jet orifice plate are in communication with the pressure chambers respectively. When the liquid jet head is in operation, the piezoelectric element is deformed under driving of a voltage, and the deformation is transferred to the vibrating plate to cause a change in volume of the pressure chamber, so that liquid in the pressure chamber jets from the jet orifice to complete the printing.

An existing liquid jet apparatus includes a substrate, a vibrating plate and a piezoelectric element arranged on a first face of the substrate and a jet orifice plate bonded on a second face (opposite to the first face) of the substrate. The existing liquid jet apparatus is manufactured as follows: forming a vibrating plate and a piezoelectric element on a first face of a substrate, etching, by means of performing an etching process on a second face of the substrate, the substrate to form a plurality of pressure chambers for storing liquid corresponding to positions of piezoelectric elements and a common chamber corresponding to the position of an ink supply hole, and finally, bonding a jet orifice plate on the second face of the substrate, so that a plurality of jet orifices on the jet orifice plate are in communication with the pressure chambers respectively. When the liquid jet apparatus is in operation, the piezoelectric element is deformed under driving of a voltage, and the deformation is transferred to the vibrating plate to cause a change in volume of the pressure chamber, so that liquid in the pressure chamber jets from the jet orifice to complete the print.

However, in order to improve a print resolution of the printer, the number of pressure chambers of the liquid jet head or the liquid jet apparatus needs to be increased. Since the existing pressure chamber of the liquid jet head or the liquid jet apparatus is formed by etching on the substrate, increasing the number of the pressure chambers means to reduce the sidewall thickness of adjacent pressure chambers, which inevitably causes that the mechanical strength of the silicon wafer as the substrate is decreased, and the substrate is broken readily during the manufacturing process, thereby resulting in that the yield of the liquid jet head or the liquid jet apparatus is reduced and the manufacturing cost is relatively high. Besides, since the jet orifice plate is boned on the substrate of the pressure chamber by an adhesive, if the adhesive flows into the pressure chamber, print quality also can be affected.

SUMMARY

The present invention provides a liquid jet head, a method for integrally manufacturing a liquid jet apparatus, and a device, so as to solve technical defects in the prior art that a liquid jet head manufactured by a liquid jet head manufacturing method of the prior art or a liquid jet apparatus manufactured by the method for integrally manufacturing a liquid jet apparatus of the prior art has a low yield, relatively high manufacturing cost and relatively poor print quality.

According to a first aspect of the present invention, there is provided a liquid jet head manufacturing method, including:

forming multiple pressure-generating members arranged spaced apart on a first substrate;

forming, on a first surface of the first substrate, pressure chambers corresponding to the multiple pressure-generating members, and a common chamber in communication with the multiple pressure chambers;

forming a transition layer on the pressure chambers by means of a bonding process, and forming a jet orifice plate on the transition layer; and forming, on the jet orifice plate and the transition layer, jet orifices in communication with the pressure chambers by means of a photo-etching process.

According to a second aspect of the present invention, there is provided a method for integrally manufacturing a liquid jet apparatus, including:

forming multiple pressure-generating members arranged spaced apart on a first substrate;

forming, on a first surface of the first substrate, pressure chambers corresponding to the multiple pressure-generating members, and a common chamber in communication with the multiple pressure chambers;

forming a jet orifice plate on the pressure chambers by means of a bonding process, and forming, on the jet orifice plate, jet orifices in communication with the pressure chambers by means of a photo-etching process.

According to a third aspect of the present invention, there is provided a liquid jet head, which is manufactured by the liquid jet head manufacturing method described above.

According to a fourth aspect of the present invention, there is provided a printing apparatus, which includes the liquid jet head described above.

According to a fifth aspect of the present invention, there is provided a liquid jet apparatus, which is manufactured by the method for integrally manufacturing the liquid jet apparatus described above.

According to the liquid jet head, the method for integrally manufacturing the liquid jet apparatus, and the device provided in the present invention, the pressure chambers and the common chamber are formed on the first surface of the first substrate; when the number of pressure chambers of the liquid jet head needs to be increased, since the pressure chambers are formed on the first substrate individually in this embodiment, the mechanical strength of the first substrate will not be reduced, and during the manufacturing process, breakage of the first substrate can be avoided, and thus improving the yield of the liquid jet head, and reducing the manufacturing cost. Moreover, the transition layer is formed by means of the bonding process, the jet orifice plate is formed on the transition layer, and the jet orifices are formed on the jet orifice plate and the transition layer by means of the photo-etching process, thus preventing the adhesive from flowing into the pressure chambers, and improving print quality of the liquid jet head.

BRIEF DESCRIPTION OF DRAWINGS

In order to illustrate technical solutions in embodiments of the present invention or the prior art more clearly, accompanying drawings needed for describing the embodiments or the prior art will be introduced in brief hereinafter. Apparently, the accompanying drawings show certain embodiments of the invention, and persons skilled in the art can derive other drawings from them without creative efforts.

DESCRIPTION OF EMBODIMENTS

In order to make the objects, technical solutions, and advantages of embodiments of the present invention clearer, the technical solutions in embodiments of the present invention are hereinafter described clearly and comprehensively with reference to the accompanying drawings in embodiments of the present invention. Obviously, the embodiments described here are part of the embodiments of the present invention and not all of the embodiments. All other embodiments, which can be derived by persons skilled in the art from the embodiments given herein without creative efforts, shall fall within the protection scope of the present invention.

Figure 1:
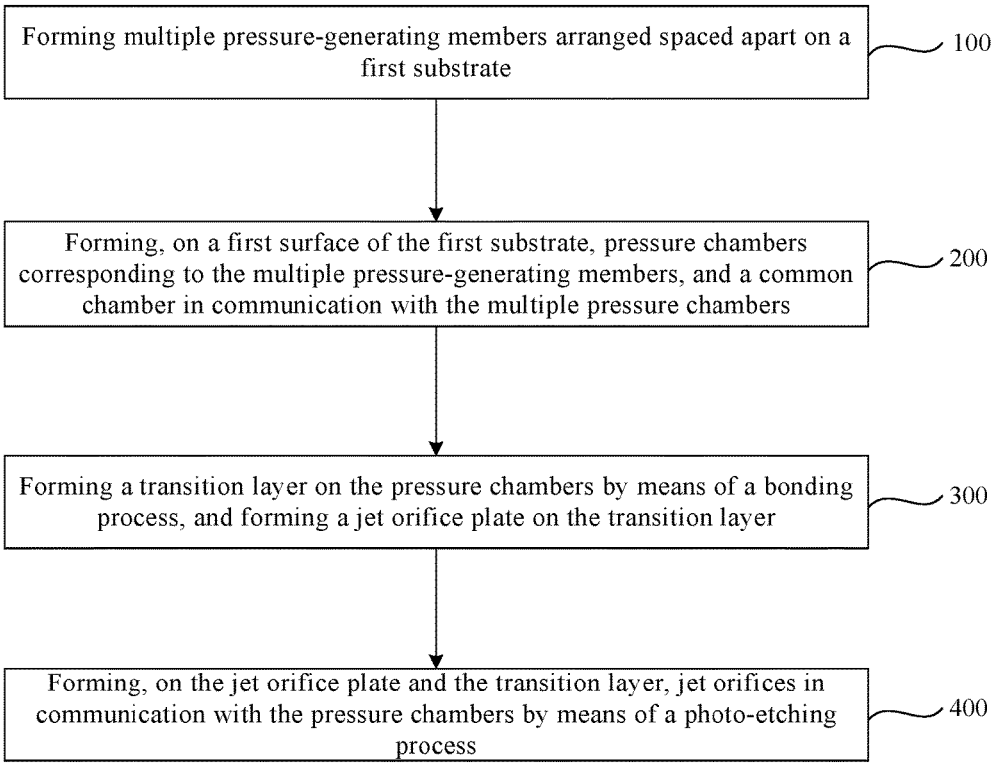
FIG. 1 is a flowchart of a liquid jet head manufacturing method according to an embodiment of the present invention.

FIG. 1 is a flowchart of a liquid jet head manufacturing method according to an embodiment of the present invention. As shown in FIG. 1, the liquid jet head manufacturing method according to this embodiment includes:

Step 100, Forming multiple pressure-generating members arranged spaced apart on a first substrate.

Step 200, Forming, on a first surface of the first substrate, pressure chambers corresponding to the multiple pressure-generating members, and a common chamber in communication with the multiple pressure chambers.

Figure 2:
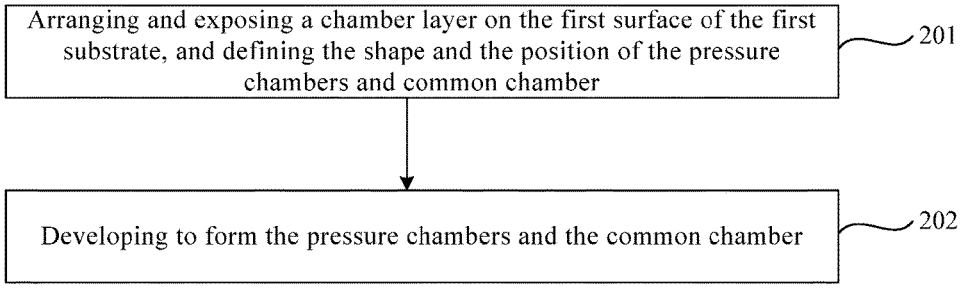
FIG. 2 is a flowchart of step 200 in FIG. 1 according to a specific implementation.

In particular, FIG. 2 is a flowchart of step 200 in FIG. 1 according to a specific implementation. As shown in FIG. 2, the step 200, forming, on the first surface of the first substrate, pressure chambers corresponding to the multiple pressure-generating members, and the common chamber in communication with the multiple pressure chambers, can include:

Step 201, Arranging and exposing a chamber layer on the first surface of the first substrate, and defining shapes and positions of the pressure chambers and the common chamber.

Figure 6:
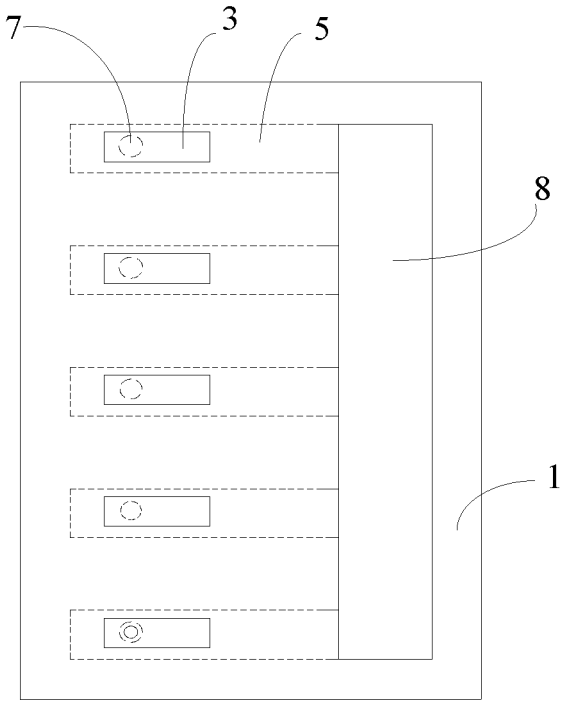
FIG. 6 is a schematic structural diagram of a liquid jet head manufactured according to an embodiment of the present invention.
Figure 7A:
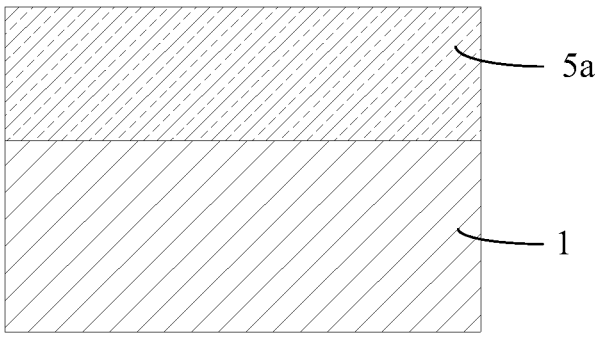
FIG. 7A to FIG. 7I are structural views in a product manufacturing process of step 200 in an embodiment of the present invention according to a specific implementation.

In particular, FIG. 6 is a schematic structural diagram of a liquid jet head manufactured according to an embodiment of the present invention; FIG. 7A to FIG. 7I are structural views in a product manufacturing process of step 200 in an embodiment of the present invention according to a specific implementation. As shown in FIG. 6 and FIG. 7A, the first substrate 1 can be a silicon substrate, the first surface of the first substrate 1 is an upper surface of the first substrate 1 shown in the figures; a chamber layer 5*a*, the material of which can be negative photosensitive adhesive SU8 or polyimide with a good machining property, is applied in a spin way on the first surface of the first substrate 1; particularly, the chamber layer 5*a* can be applied on the whole upper surface of the first substrate 1, and the thickness of the chamber layer 5*a* matches with the heights of the pressure chamber and the common chamber.

Figure 7B:
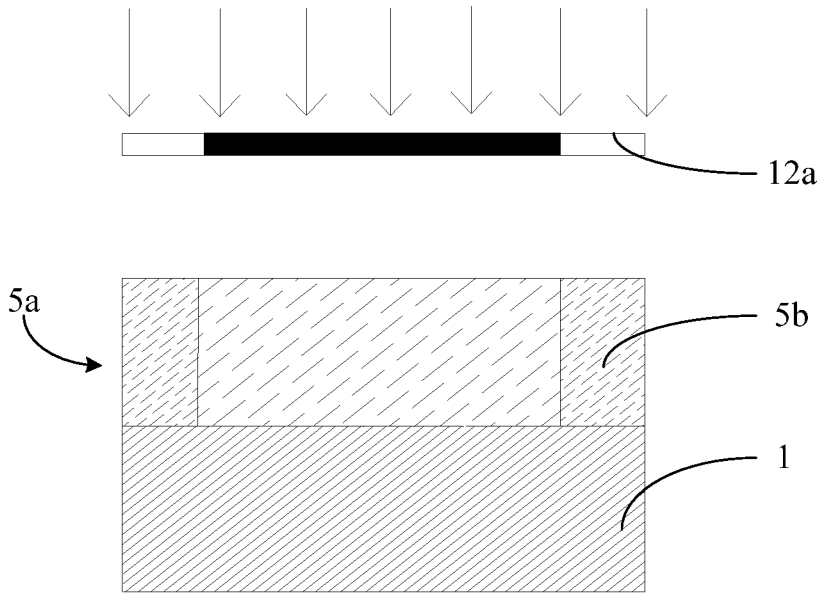

As shown in FIG. 6 and FIG. 7B, the chamber layer 5*a* can be exposed by using a mask plate 12*a*, and the shapes and positions of the pressure chambers 5 and the common chamber 8 are defined by means of a structural form of the mask plate 12*a* and an exposure process, particularly, the chamber wall 5*b* is cured, and will not be removed by a developing solution used in the subsequent process.

Step 202, Developing to form the pressure chamber and the common chamber.

Figure 7C:
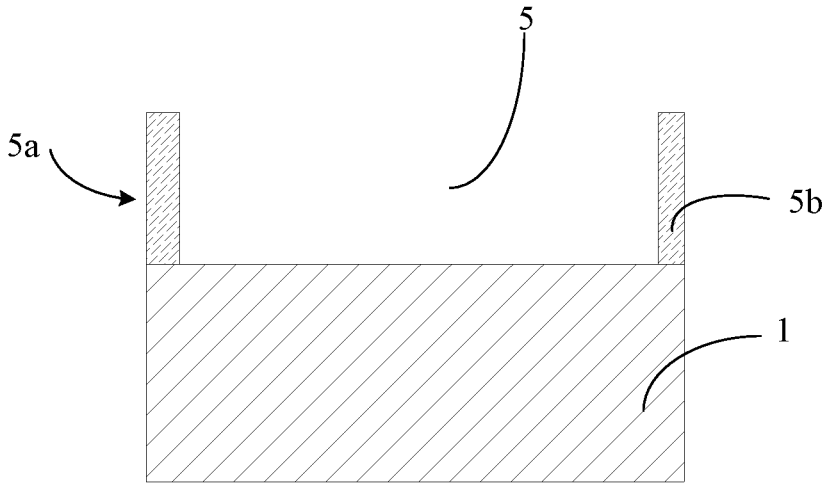

As shown in FIG. 7C, the chamber layer 5*a* can be developed with a developing solution, the cured chamber wall 5*b* is left remaining, and the pressure chamber 5 and the common chamber 8 are formed after the rest is removed (as shown in FIG. 6).

Figure 3:
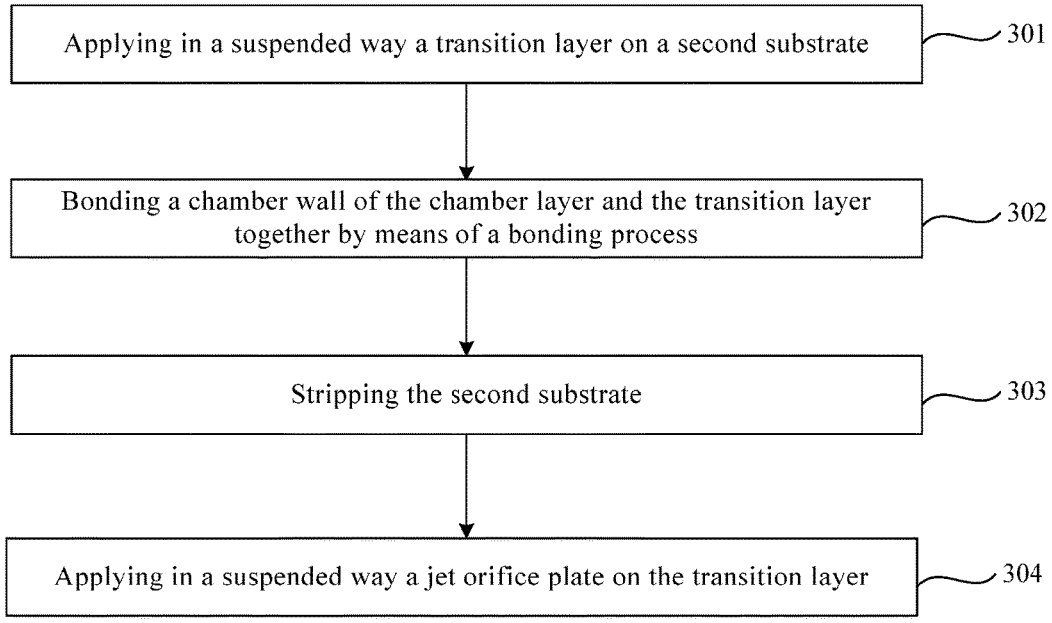
FIG. 3 is a flowchart of step 300 in FIG. 1 according to a specific implementation.

Step 300, Forming a transition layer on the pressure chambers by means of a bonding process, and forming a jet orifice plate on the transition layer. In particular, FIG. 3 is a flowchart of step 300 in FIG. 1 according to a specific implementation; as shown in FIG. 3, step 300 can include:

Step 301, Applying in a spin way a transition layer on a second substrate.

Figure 7D:
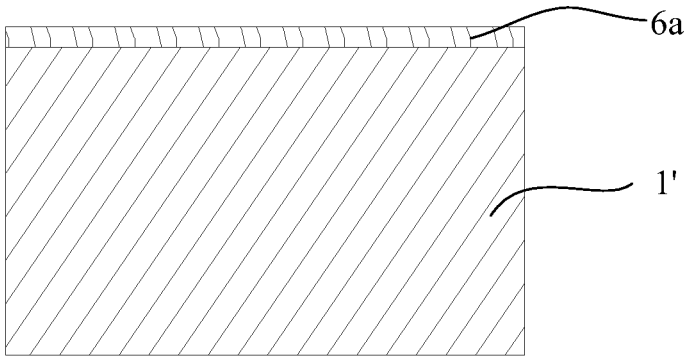

As shown in FIG. 7D, the material of the second substrate 1' can be organic glass etc., and the material of the transition layer 6*a* can be negative photosensitive adhesive SU8 or polyimide with a good machining property.

Figure 7E:
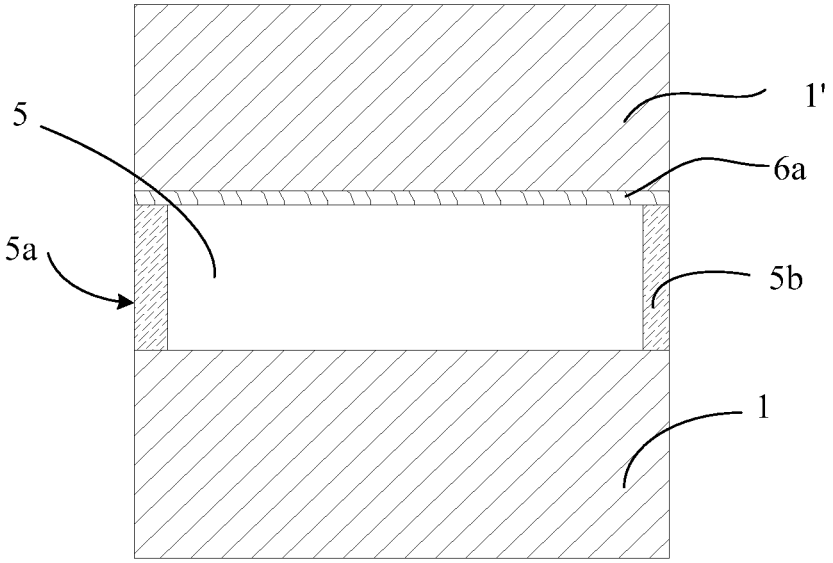

Step 302, Bonding the chamber wall of the chamber layer and the transition layer together by means of a bonding process; as shown in FIG. 7E, the transition layer 6*a* can be arranged thinner, so that the transition layer 6*a* and the chamber wall of the chamber layer can be bonded together in an even better fashion.

Figure 7F:
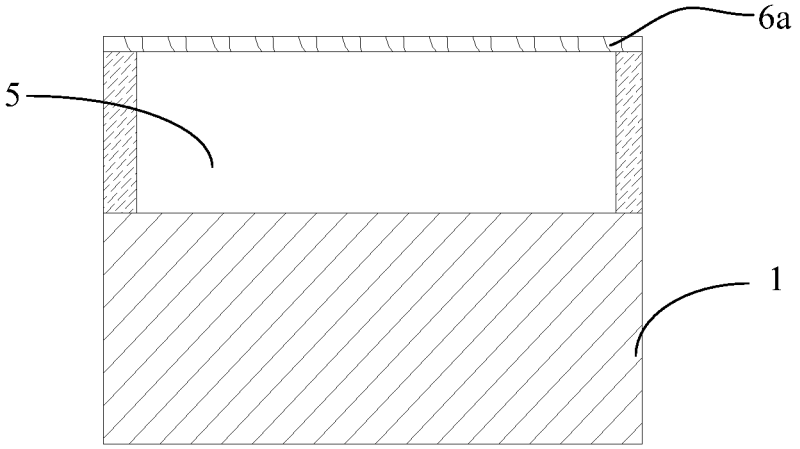

Step 303, Stripping the second substrate, as shown in FIG. 7F.

Figure 7G:
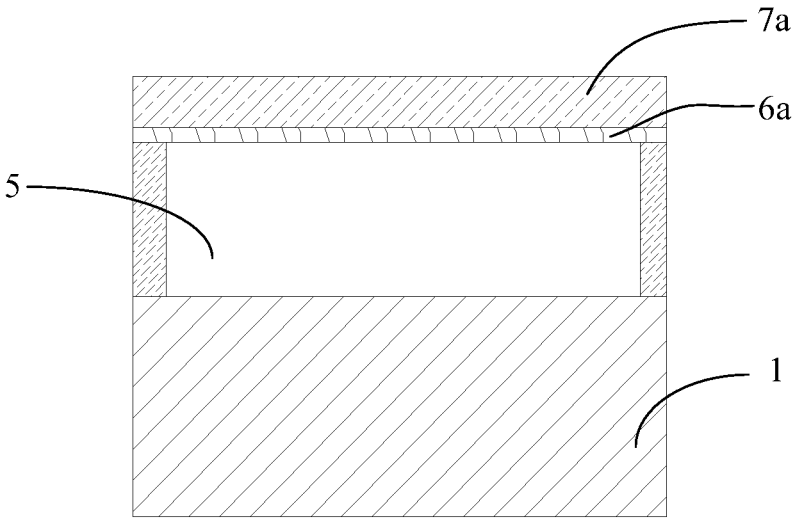

Step 304, Applying in a spin way a jet orifice plate on the transition layer. As shown in FIG. 7G, a thicker jet orifice plate 7*a* can be applied in a spin way on the transition layer 6*a*, and the material of the jet orifice plate 7*a* can be negative photosensitive adhesive SU8 or polyimide with a good machining property. Since the jet orifice plate 7*a* is formed on the transition layer 6*a*, a thicker orifice plate 7*a* can be formed in an even better fashion.

Step 400, Forming, on the jet orifice plate and the transition layer, jet orifices in communication with the pressure chambers by means of a photo-etching process.

Figure 7H:
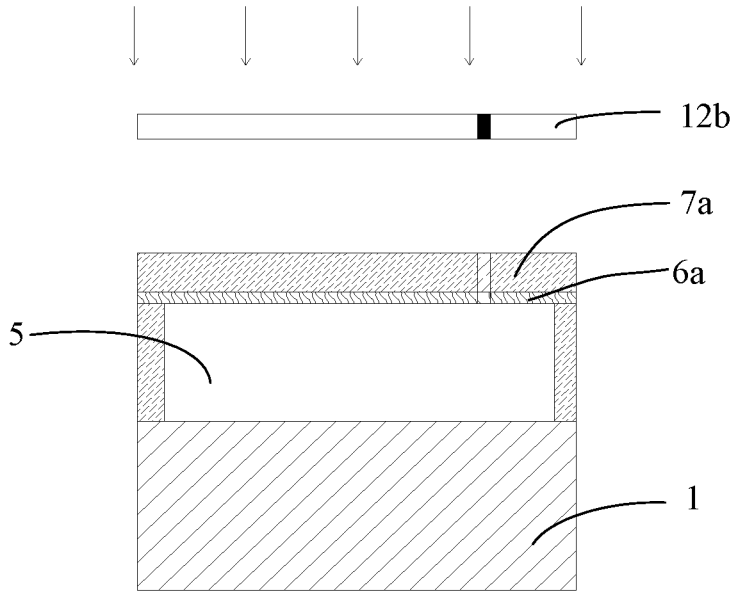
Figure 7I:
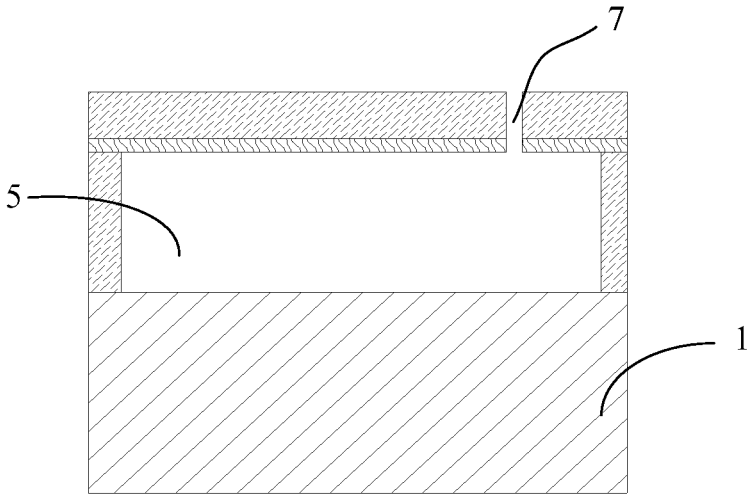

In particular, as shown in FIG. 7G and FIG. 7H, the jet orifice plate 7*a* can be exposed by using a mask plate 12*b*, and shapes and positions of the jet orifices are defined by means of a structural form of the mask plate 12*b* and an exposure process particularly, the jet orifice wall is cured, and will not be removed by a developing solution used in the subsequent process. The jet orifice plate 7*a* is developed by a developing solution, the cured jet orifice wall is left remaining, and a jet orifice 7 is formed after the rest is removed.

According to the liquid jet head manufacturing method provided in this embodiment, the pressure chambers and the common chamber are formed on the first surface of the first substrate; when the number of pressure chambers of the liquid jet head needs to be increased, since the pressure chambers are formed on the first substrate individually in this embodiment, the mechanical strength of the first substrate will not be reduced, and during the manufacturing process, breakage of the first substrate can be avoided, and thus improving the yield of the liquid jet head, and reducing the manufacturing cost. Moreover, the transition layer is formed by means of the bonding process, the jet orifice plate is formed on the transition layer, and the jet orifices are formed on the jet orifice plate and the transition layer by means of the photo-etching process, thus preventing the adhesive from flowing into the pressure chambers, and improving print quality of the liquid jet head.

Figure 4:
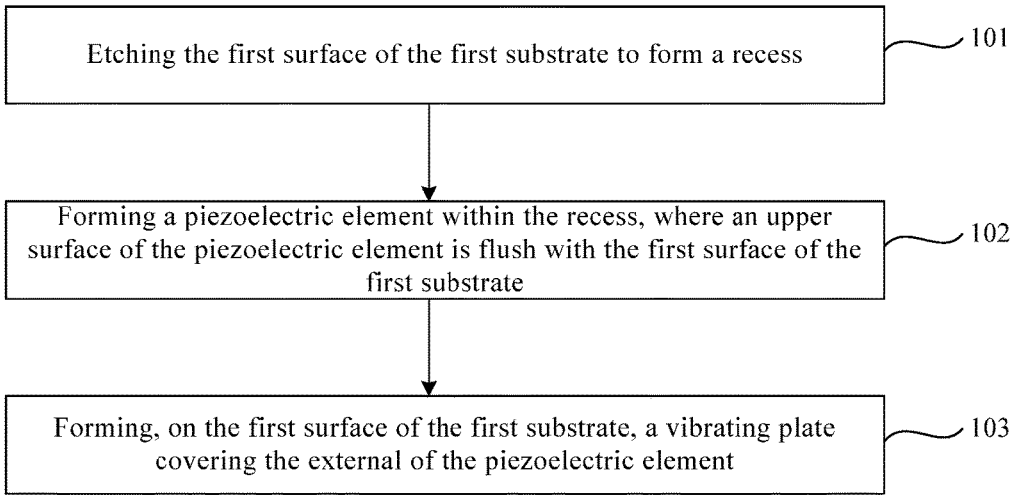
FIG. 4 is a flowchart of step 100 in FIG. 1 according to a specific implementation.

FIG. 4 is a flowchart of step 100 in FIG. 1 according to a specific implementation, and FIG. 8A to FIG. 8G are structural views in a product manufacturing process according to another implementation of the present invention. As shown in FIG. 4, on the basis of technical solutions of the above embodiments, step 100, forming multiple pressure-generating members arranged spaced apart on the first substrate, can include:

Step 101, Etching the first surface of the first substrate to form a recess.

Figure 8A:
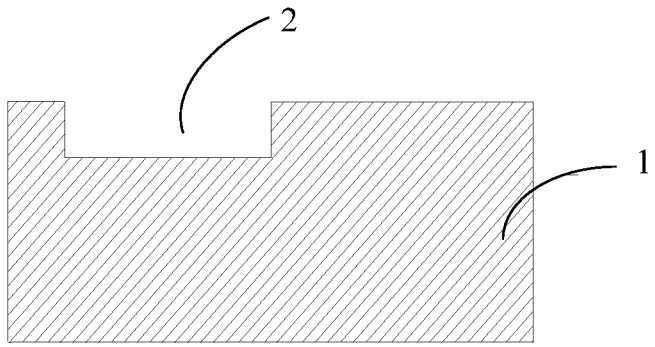
FIG. 8A to FIG. 8G are structural views in a product manufacturing process according to another implementation of the present invention.

As shown in FIG. 8A, in particular, the first surface of the first substrate 1 is etched using dry etching or wet etching to form a recess 2, and the recess 2 is used to accommodate the pressure-generating member.

Step 102, Forming a piezoelectric element within the recess, where an upper surface of the piezoelectric element is flush with the first surface of the first substrate.

Figure 8B:
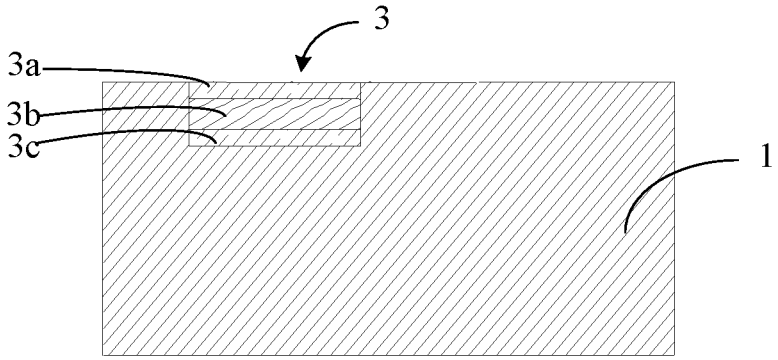

As shown in FIG. 8B, a lower electrode layer 3*c*, a piezoelectric layer 3*b* and an upper electrode layer 3*a* can be formed sequentially by sputtering within the recess 2; particularly, the lower electrode layer 3*c* is a titanium (Ti) layer, a platinum (Pt) layer or a superimposed layer consisting of multiple titanium layers; the piezoelectric layer 3*b* is a lead zirconate titanate (PZT) layer; the upper electrode layer 3*a* is a platinum (Pt) layer or a gold layer.

Step 103, Forming, on the first surface of the first substrate, a vibrating plate covering the external of the piezoelectric element.

Figure 8C:
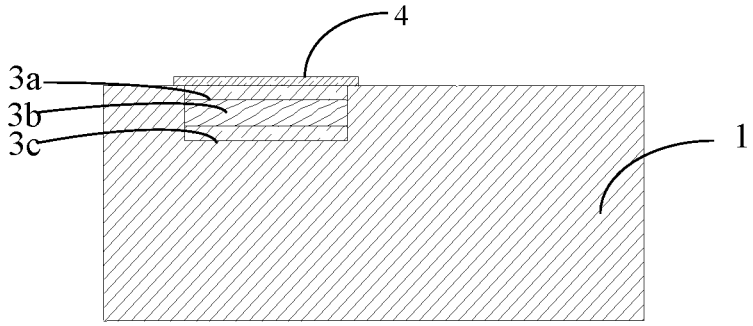

As shown in FIG. 8C, a vibrating plate 4 is formed on the first surface of the first substrate 1 by a low pressure chemical vapor deposition or a plasma enhanced chemical vapor deposition, and the material of the vibrating plate 4 can be SiO2 or Si3N4 or a stack of SiO2-Si3N4; the vibrating plate 4 covers the external of the upper electrode layer 3*a*, and the outer edge is provided over the first surface of the first substrate 1.

Figure 8D:
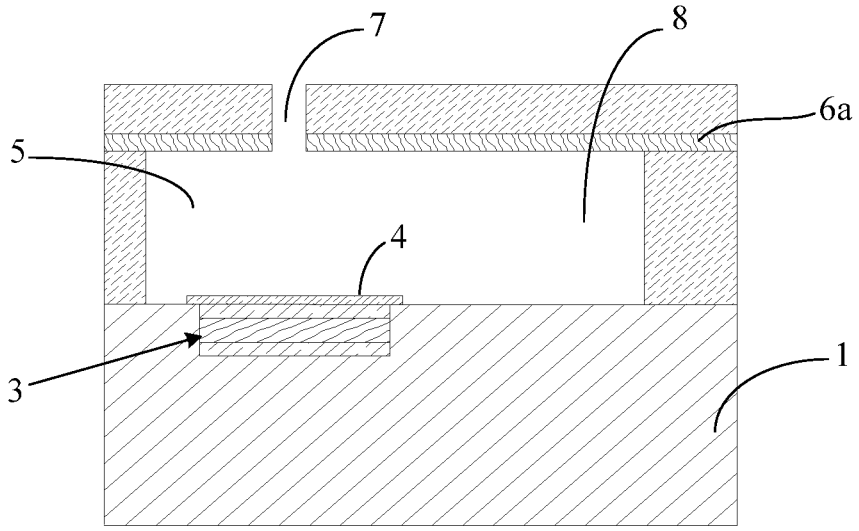

Then, as shown in FIG. 8D, the pressure chambers 5, the transition layer 6*a*, the common chamber 8 and the jet orifices 7 are formed according to the manufacturing method in the above embodiments; the above chambers and the jet orifice formed by the above method can improve a print resolution and minimize the liquid jet head.

Figure 5:
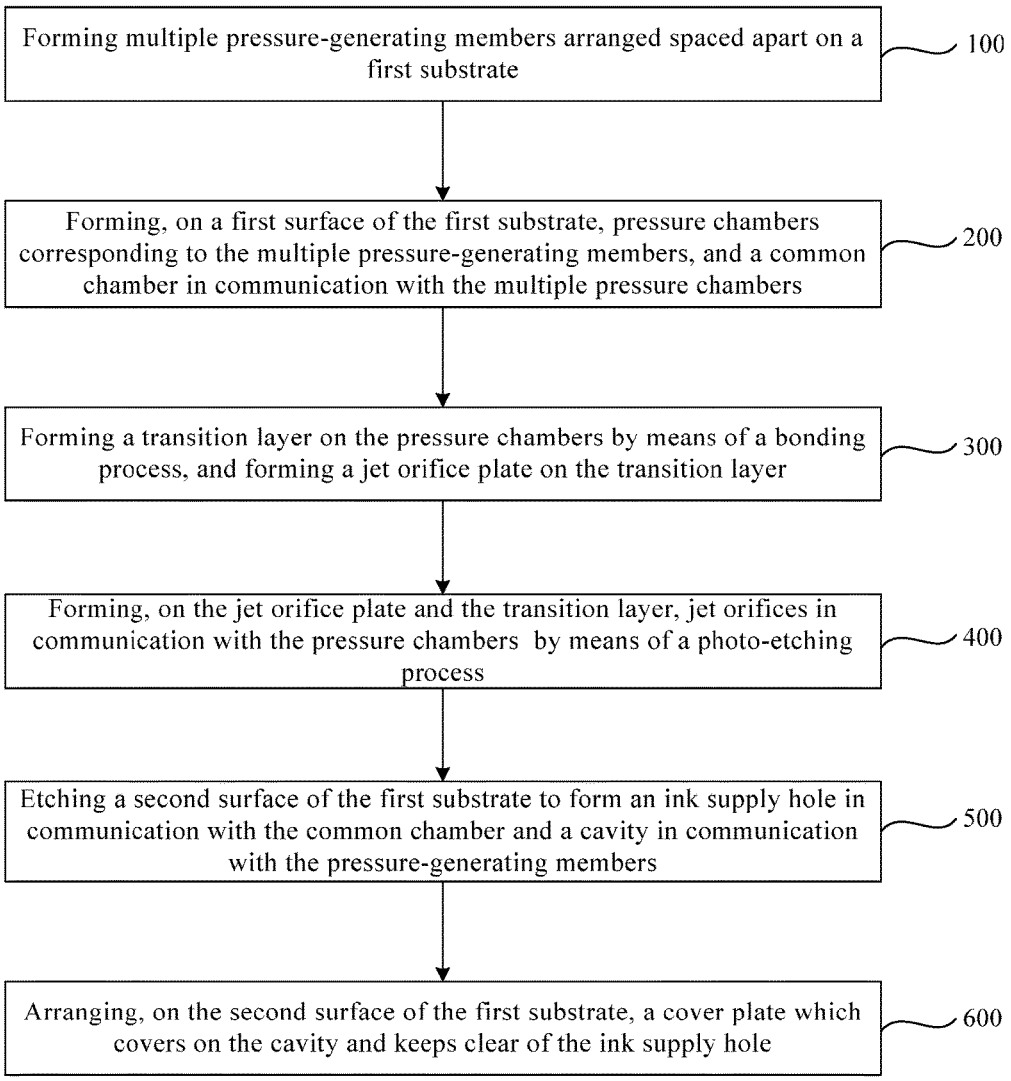
FIG. 5 is a flowchart of a liquid jet head manufacturing method according to another embodiment of the present invention.

FIG. 5 is a flowchart of a liquid jet head manufacturing method according to another embodiment of the present invention; further, as shown in FIG. 5, after step 400 of the above manufacturing method, the method also can include:

Step 500, Etching a second surface of the first substrate to form an ink supply hole in communication with the common chamber and a cavity in communication with the pressure-generating members.

Figure 8E:
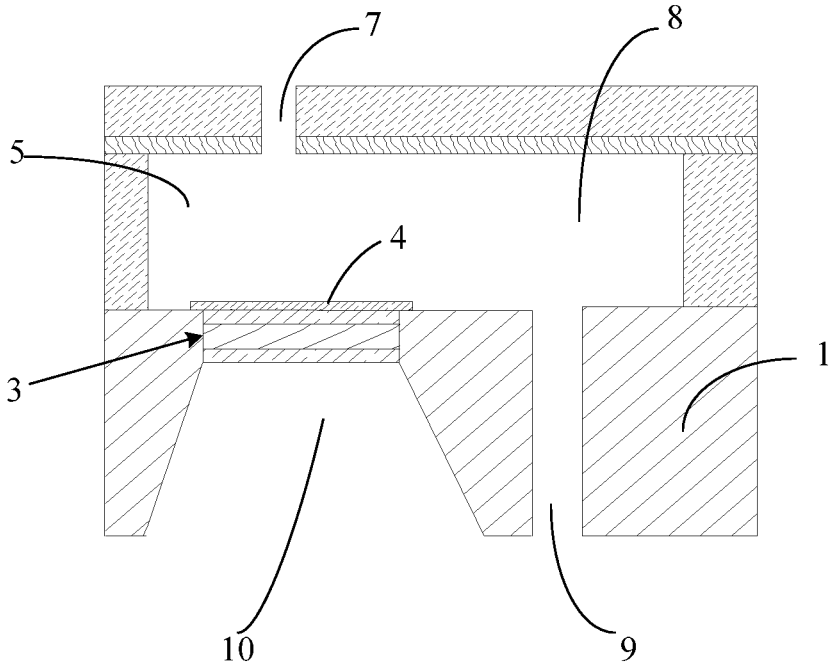

As shown in FIG. 8E, a second surface (a lower surface of the first substrate 1 as shown in the figure) of the first substrate 1 can be etched using dry etching to form an ink supply hole 9 in communication with the common chamber 8 and a cavity 10 in communication with the lower electrode layer 3*c* of the piezoelectric element 3, where, the cavity 10 can increase the vibration amplitude of the piezoelectric element 3.

Figure 8F:
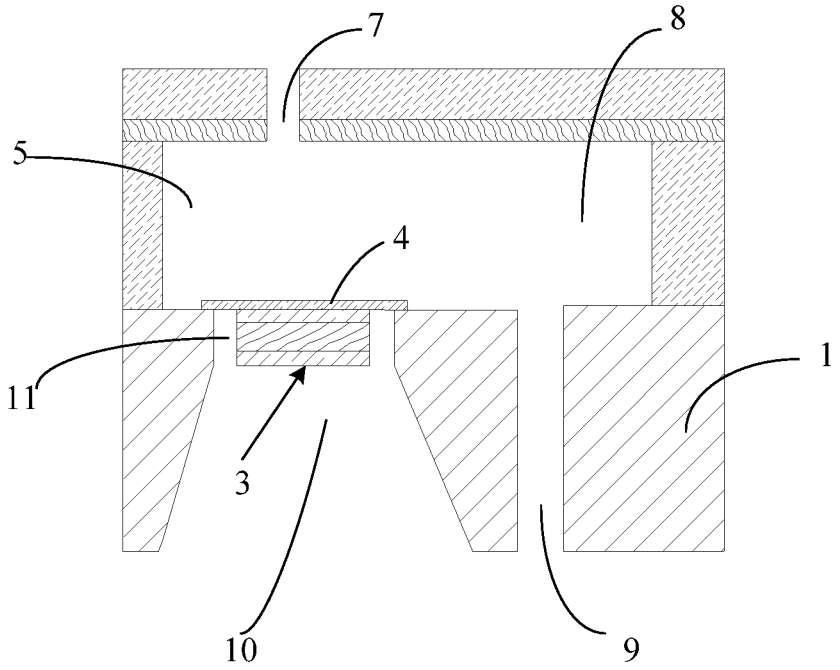

In order to further improve the vibration performance of the piezoelectric element 3, as shown in FIG. 8F, a gap 11 can be formed between both sides of the piezoelectric element 3 and the first substrate 1; the gap 11 can guarantee that the piezoelectric element 3 is not constrained by the first substrate 1 while vibrating, which can improve the vibration amplitude.

Step 600, Arranging, on the second surface of the first substrate, a cover plate which covers on the cavity and keeps clear of the ink supply hole.

Figure 8G:
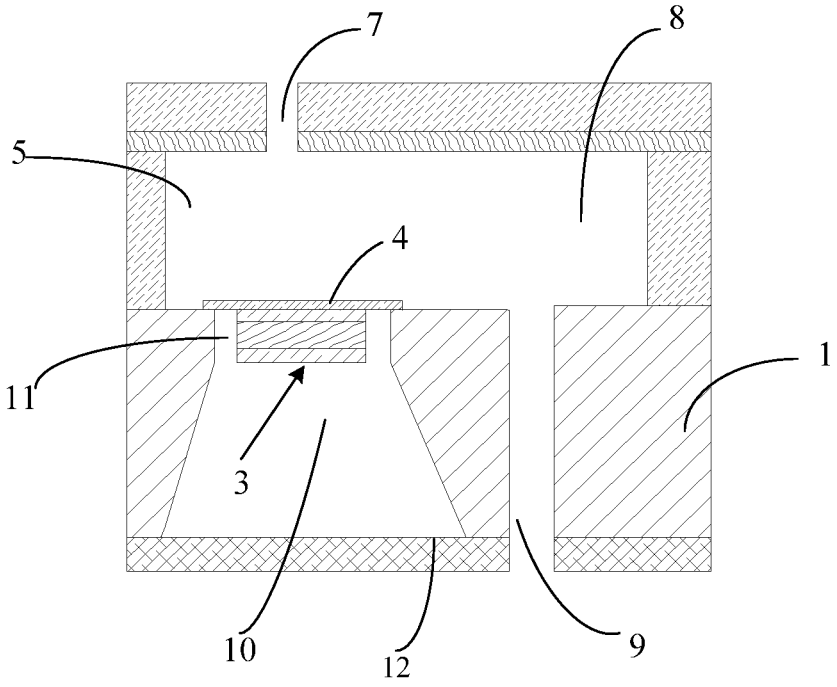

As shown in FIG. 8G, a cover plate 12 is bonded to the second surface of the first substrate 1, to complete the manufacturing process of the liquid jet head, and the material of the cover plate 12 can be polymethyl methacrylate (PMMA).

In technical solutions of the above embodiments, step 100, forming multiple pressure-generating members arranged spaced apart on the first substrate, also can be implemented in other modes, particularly, step 100 can include:

Step 101', Forming a vibrating plate on the first surface of the first substrate.

Figure 9A:
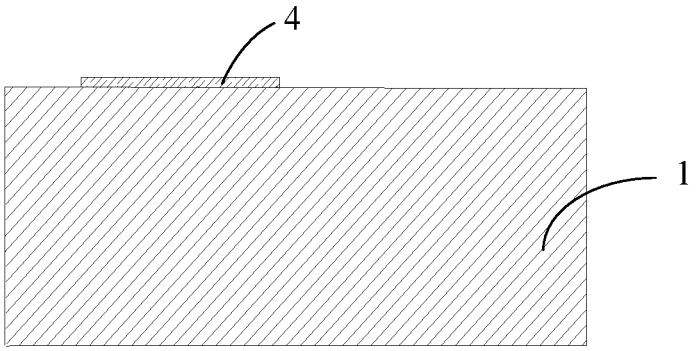
FIG. 9A to FIG. 9C are structural views in a product manufacturing process according to still another implementation of the present invention.

As shown in FIG. 9A, a vibrating plate can be formed on the first surface of the first substrate 1 by a low pressure chemical vapor deposition or a plasma enhanced chemical vapor deposition; the material of the vibrating plate is SiO2 or Si3N4 or a stack of SiO2-Si3N4.

Step 102', Forming a piezoelectric element on the vibrating plate.

Figure 9B:
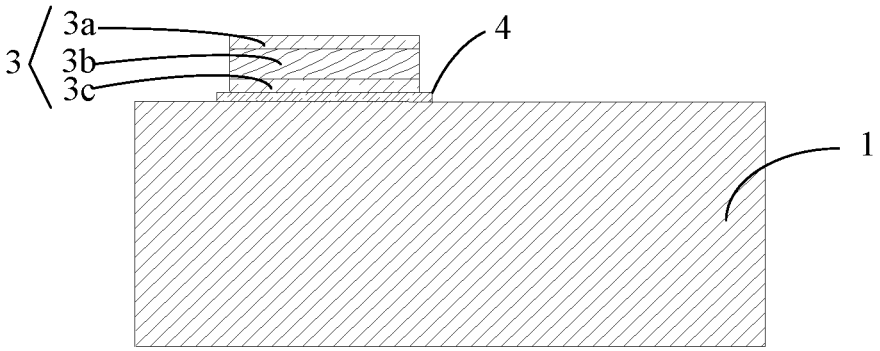

As shown in FIG. 9B, a lower electrode layer 3*c* can be formed by sputtering, a piezoelectric layer 3*b* can be formed a sol-gel method and an upper electrode layer 3*a* can be formed by sputtering; particularly, the lower electrode layer 3*c* can be a titanium (Ti) layer, a platinum (Pt) layer or a superimposed layer consisting of multiple titanium layers; the piezoelectric layer can be a lead zirconate titanate (PZT) layer; the upper electrode layer can be a platinum (Pt) layer or a gold layer.

Figure 9C:
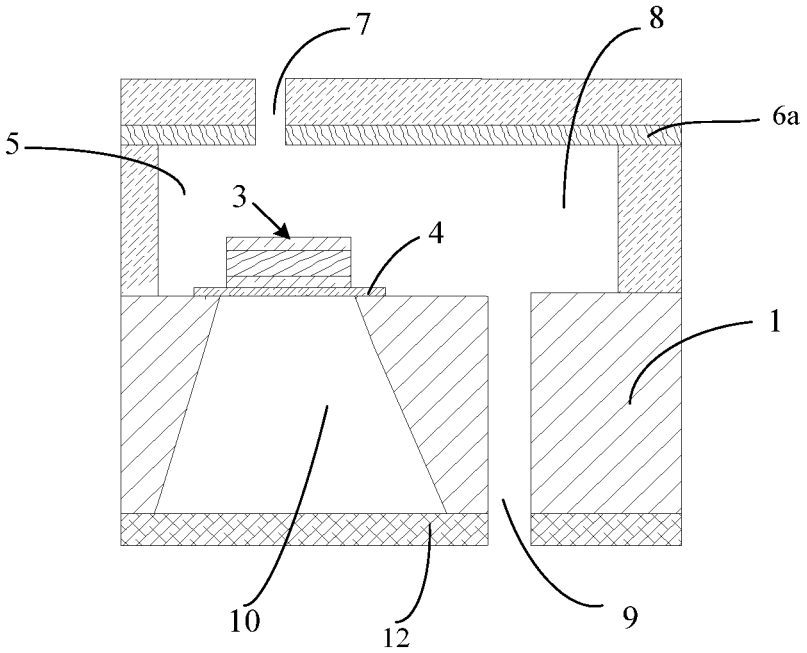

As shown in FIG. 9C, then, the pressure chambers 5, the transition layer 6*a*, the common chamber 8 and the jet orifices 7 can be formed on the first surface of the first substrate 1 according to the manufacturing method in the above embodiments. The second surface of the first substrate 1 is etched to form the ink supply hole 9 in communication with the common chamber 8 and the cavity 10 in communication with the lower electrode layer 3*c* of the pressure element 3. The cover plate 12 is arranged on the second surface of the first substrate 1, and the cover plate 12 is arranged covering on the cavity 10 and keeping clear of the ink supply hole 9.

Figure 10A:
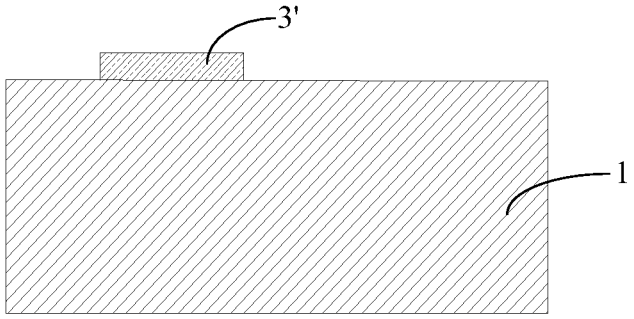
FIG. 10A to FIG. 10B are structural views in a product manufacturing process according to yet another implementation of the present invention.
Figure 10B:
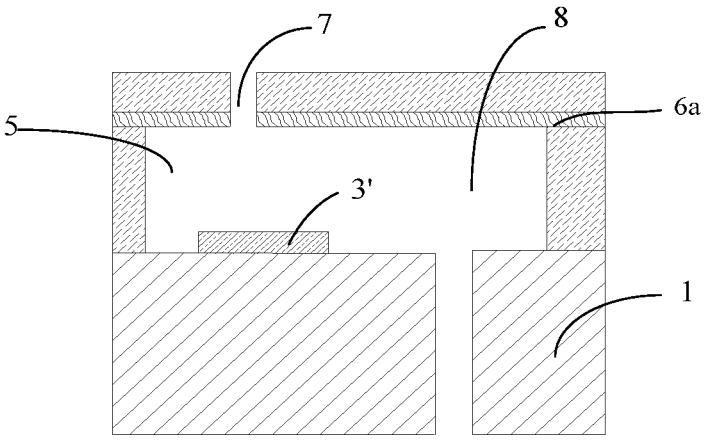

FIG. 10A to FIG. 10B are structural views in a product manufacturing process according to yet another implementation of the present invention. As shown in FIG. 10A, on the basis of technical solutions of the above embodiments, step 100, forming multiple pressure-generating members arranged spaced apart on the first substrate, particularly is:

Depositing a film resistance layer 3' on the first surface of the first substrate 1, where the material of the film resistance layer 3' is tantalum-aluminum alloy or nickel-chrome alloy or tungsten silicon nitride or titanium nitride.

Further, as shown in FIG. 10B, etching the second surface of the first substrate 1 to form the ink supply hole 9 in communication with the common chamber 8.

The specific liquid jet process of the liquid jet head manufactured by this embodiment is that: the liquid arrives at the common chamber 8 via the ink supply hole 9, and meanwhile, after a pulse signal is applied, the film resistance layer 3' heats the liquid at a speed of 1000° C./μs; the volatile component in the liquid vaporizes to form air bubbles at around 340° C., and the air bubbles expels ink droplets at the original position from the jet orifices 7; the formation of the air bubbles is reversible, when the pulse signal is released, passive cooling will cause the air bubbles to collapse instantaneously, and then, the ink droplets will jet from the jet orifices 7 completely.

Figure 11:
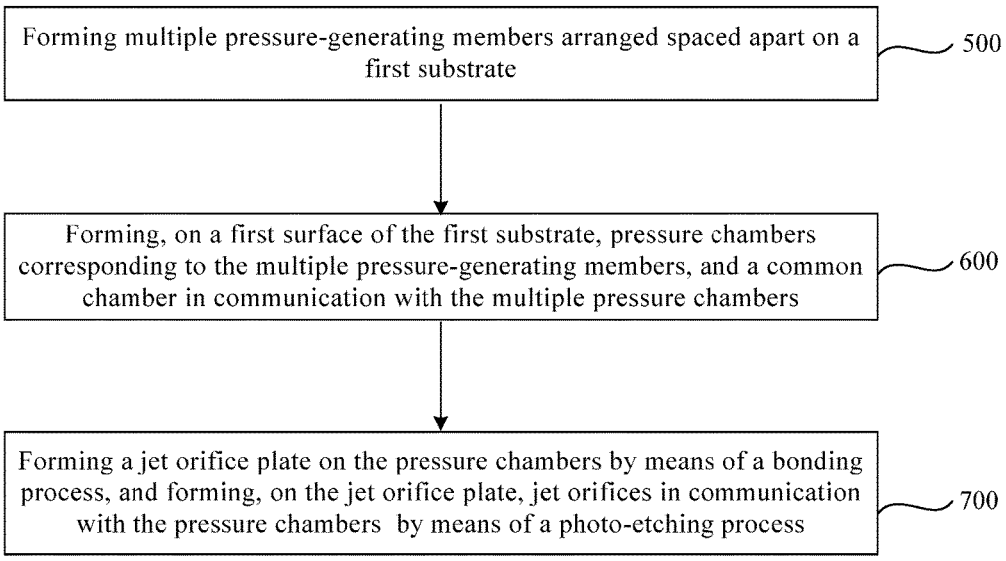
FIG. 11 is a flowchart of a method for integrally manufacturing a liquid jet apparatus according to an embodiment of the present invention.

FIG. 11 is a flowchart of a method for integrally manufacturing a liquid jet apparatus according to an embodiment of the present invention. As shown in FIG. 11, the method for integrally manufacturing the liquid jet apparatus provided in this embodiment includes:

Step 500, Forming multiple pressure-generating members arranged spaced apart on a first substrate.

Step 600, Forming, on a first surface of the first substrate, pressure chambers corresponding to the multiple pressure-generating members, and a common chamber in communication with the multiple pressure chambers.

Figure 12:
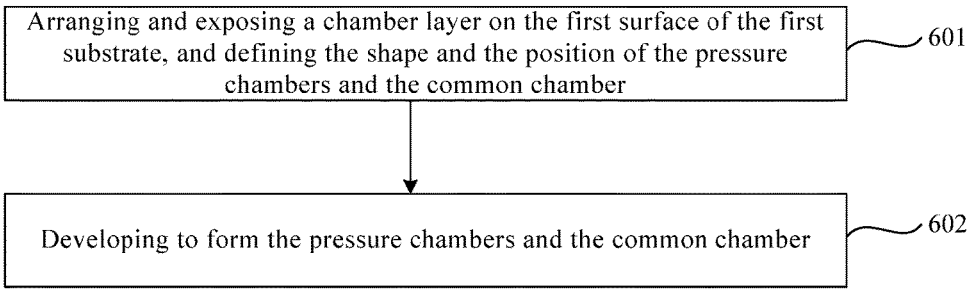
FIG. 12 is a flowchart of step 600 in FIG. 11 according to a specific implementation.

In particular, FIG. 12 is a flowchart of step 600 in FIG. 11 according to a specific implementation. As shown in FIG. 12, the step 600, forming, on the first surface of the first substrate, pressure chambers corresponding to the multiple pressure-generating members, and the common chamber in communication with the multiple pressure chambers, can include:

Step 601, Arranging and exposing a chamber layer on the first surface of the first substrate, and defining shapes and positions of the pressure chambers and the common chamber.

Figure 16:
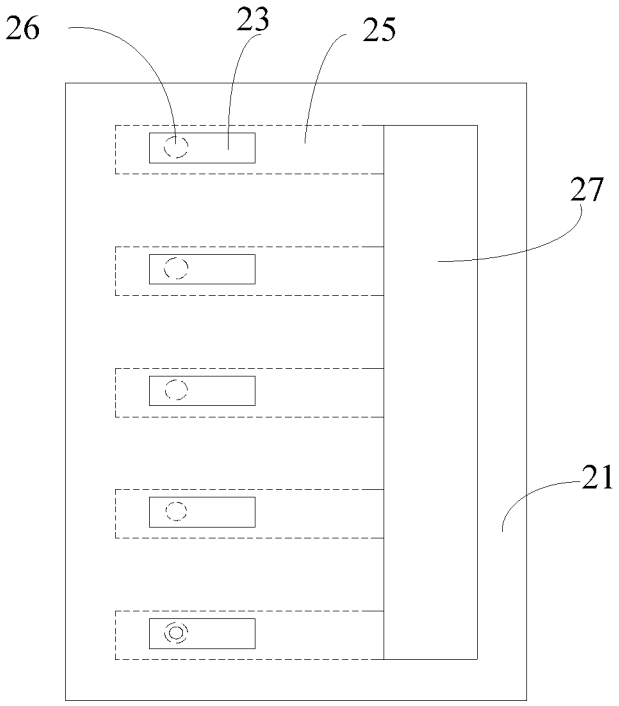
FIG. 16 is a schematic structural diagram of a liquid jet apparatus manufactured according to an embodiment of the present invention.
Figure 17A:
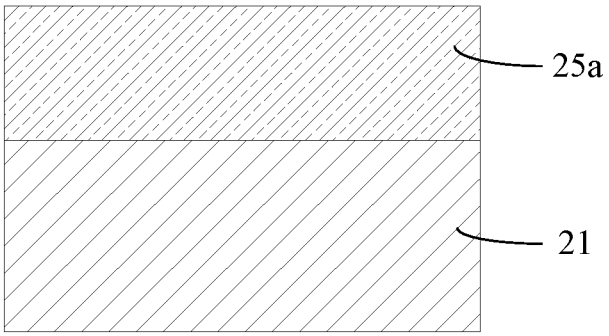
FIG. 17A to FIG. 17H are structural views in a product manufacturing process of step 600 in an embodiment of the present invention according to a specific implementation.

In particular, FIG. 16 is a schematic structural diagram of a liquid jet apparatus manufactured according to an embodiment of the present invention; FIG. 17A to FIG. 17H are structural views in a product manufacturing process of step 600 in an embodiment of the present invention according to a specific implementation. As shown in FIG. 16 and FIG. 17A, the first substrate 21 can be a silicon substrate, the first surface of the first substrate 21 is an upper surface of the first substrate 21 shown in the figures; a chamber layer 25*a*, the material of which can be negative photosensitive adhesive SU8 with a good machining property, is applied in a spin way on the first surface of the first substrate 21; particularly, the chamber layer 25*a* can be applied on the whole upper surface of the first substrate 21, and the thickness of the chamber layer 25*a* matches with the heights of the pressure chamber and the common chamber.

Figure 17B:
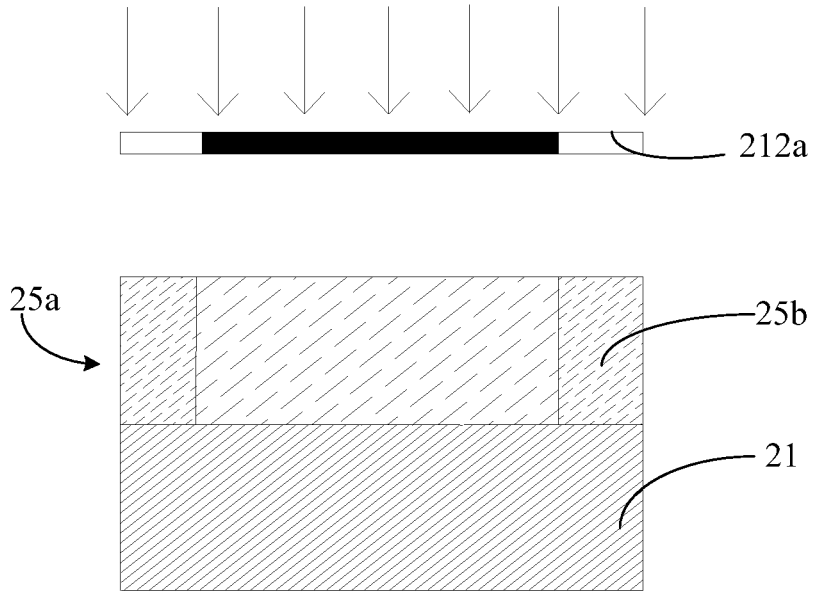

As shown in FIG. 16 and FIG. 17B, the chamber layer 25*a* can be exposed by using a mask plate 212*a*, and the shapes and the positions of the pressure chamber 25 and the common chamber 27 are defined by means of a structural form of the mask plate 212*a* and an exposure process, particularly, the chamber wall 25*b* is cured, and will not be removed by a developing solution used in the subsequent process.

Step 602, Developing to form the pressure chamber and the common chamber.

Figure 17C:
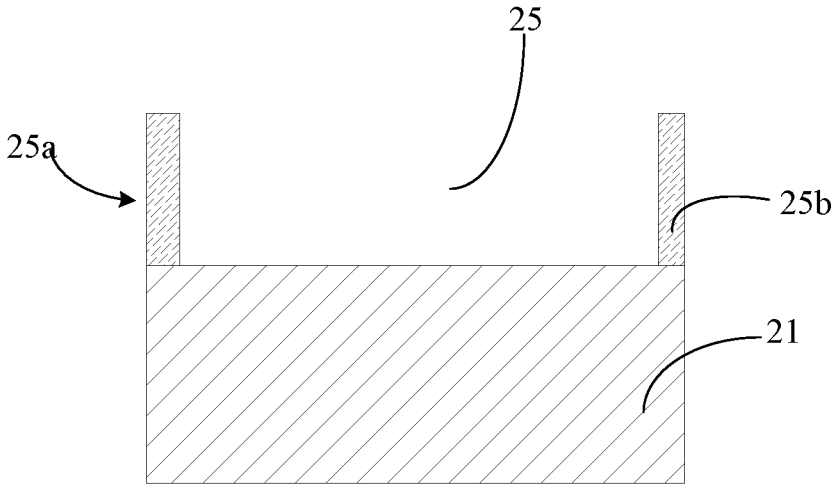

As shown in FIG. 17C, the chamber layer 25*a* can be developed with a developing solution 1,2-propanediol formate, the cured chamber wall 25*b* is left remaining, and the pressure chamber 25 and the common chamber 27 are formed after the rest is removed (as shown in FIG. 16).

Figure 13:
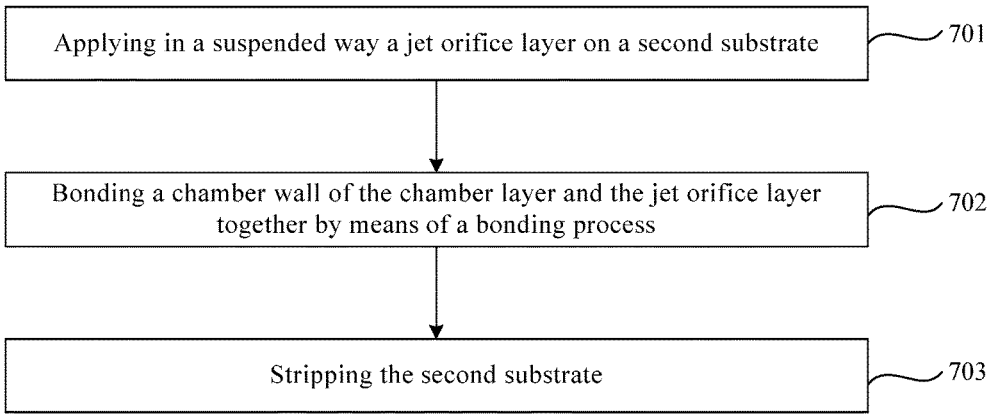
FIG. 13 is a flowchart of step 700 in FIG. 11 according to a specific implementation.

Step 700, Forming a jet orifice plate on the pressure chambers by means of a bonding process, and forming, on the jet orifice plate, jet orifices in communication with the pressure chambers by means of a photo-etching process. In particular, FIG. 13 is a flowchart of step 700 in FIG. 11 according to a specific implementation; as shown in FIG. 13, step 700 can include:

Step 701, Applying in a spin way a jet orifice layer on a second substrate.

Figure 17D:
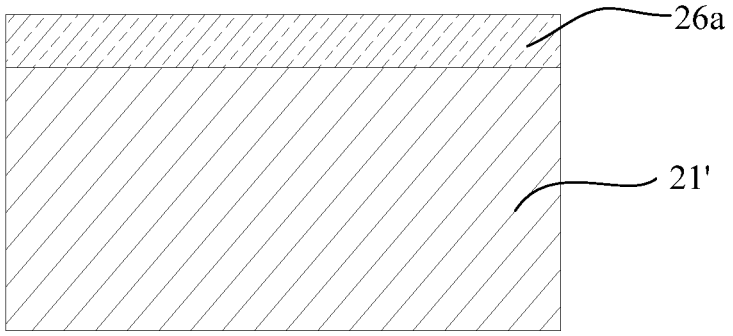

As shown in FIG. 17D, the material of the second substrate 21' can be organic glass etc., and the material of the jet orifice layer 26*a* can be negative photosensitive adhesive SU8 with a good machining property.

Figure 17E:
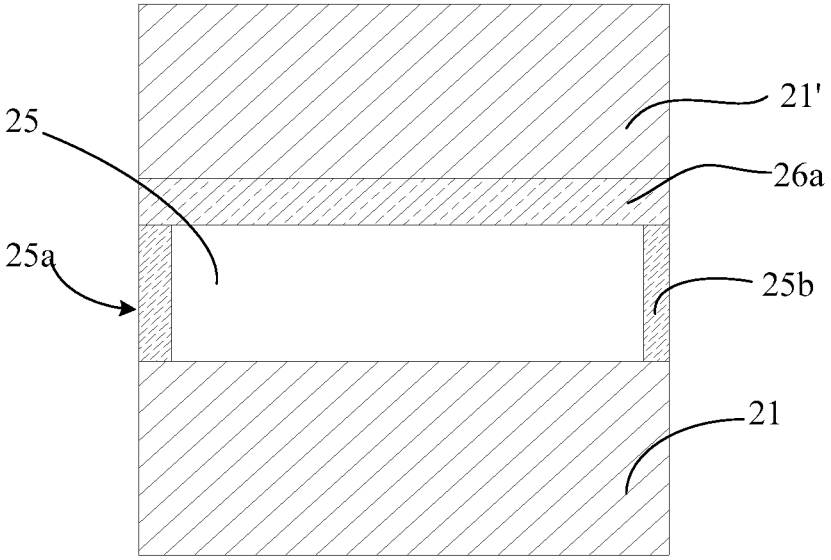

Step 702, Bonding the chamber wall of the chamber layer and the jet orifice layer together by means of a bonding process, as shown in FIG. 17E.

Figure 17F:
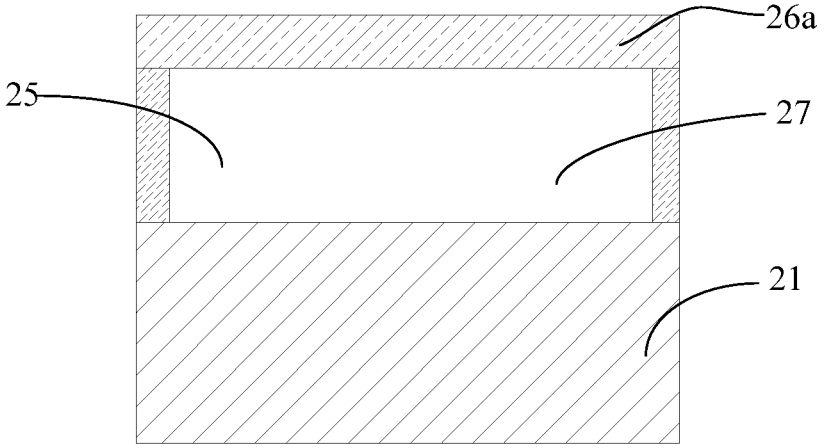

Step 703, Stripping the second substrate, as shown in FIG. 17F.

Figure 17G:
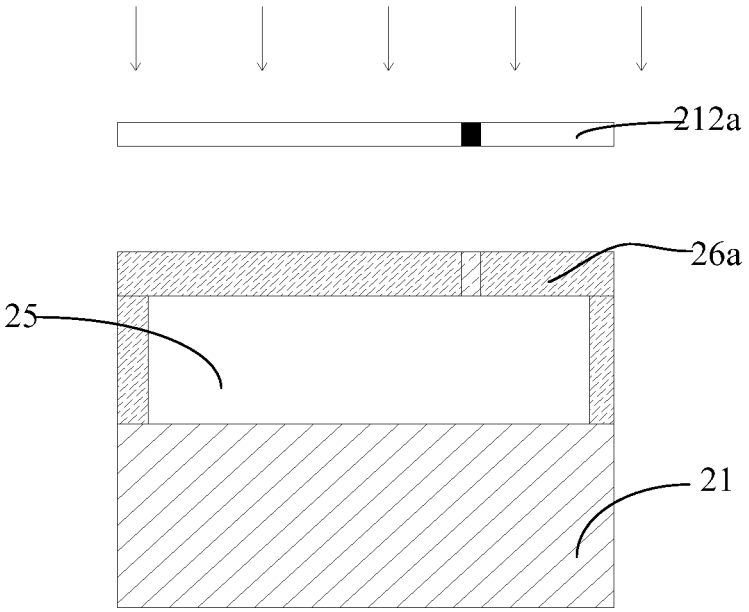
Figure 17H:
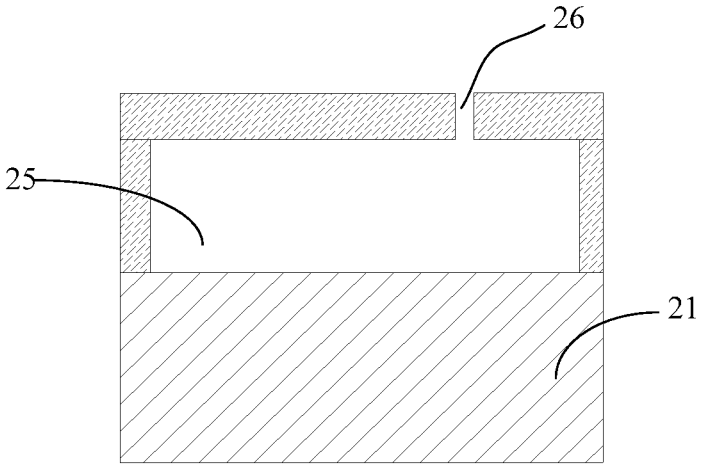

Further, as shown in FIG. 17G and FIG. 17H, the jet orifice layer 26*a* can be exposed by using a mask plate 212*b*, and shapes and positions of the jet orifices are defined by means of a structural form of the mask plate 212*b* and an exposure process, particularly, the jet orifice wall is cured, and will not be removed by a developing solution used in the subsequent process. The jet orifice layer 26*a* is developed by a developing solution 1,2-propanediol formate, the cured jet orifice wall is left remaining, and a jet orifice 26 is formed after the rest is removed.

According to the method for integrally manufacturing the liquid jet apparatus provided in this embodiment, the pressure chambers and the common chamber are formed on the first surface of the first substrate; when the number of pressure chambers of the liquid jet apparatus needs to be increased, since the pressure chambers are formed on the first substrate individually in this embodiment, the mechanical strength of the first substrate will not be reduced, and during the manufacturing process, breakage of the first substrate can be avoided, and thus improving the yield of the liquid jet apparatus, and reducing the manufacturing cost. Moreover, the jet orifice plate is formed by means of the bonding process, and the jet orifices are formed on the jet orifice plate by means of the photo-etching process, thus preventing the adhesive from flowing into the pressure chambers, and improving print quality of the liquid jet apparatus.

Figure 14:
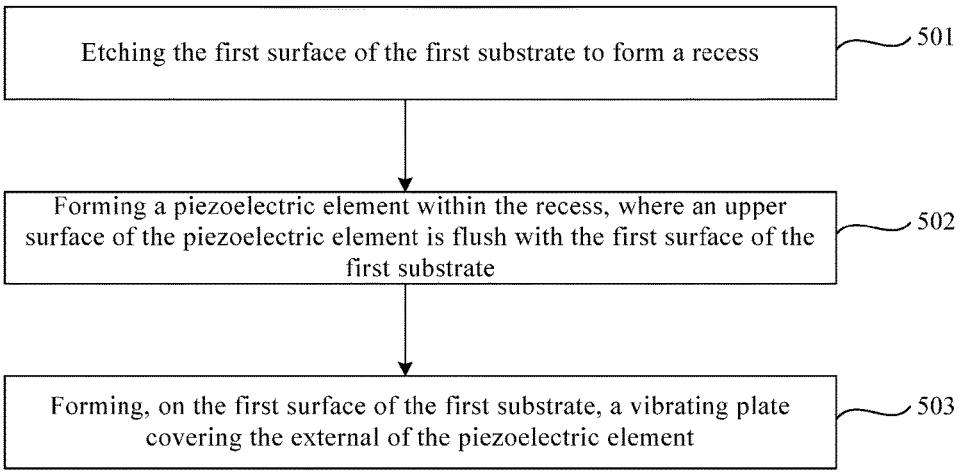
FIG. 14 is a flowchart of step 500 in FIG. 11 according to a specific implementation.

FIG. 14 is a flowchart of step 500 in FIG. 11 according to a specific implementation, and FIG. 18A to FIG. 18G are structural views in a product manufacturing process according to another implementation of the present invention. As shown in FIG. 14, on the basis of technical solutions of the above embodiments, step 500, forming multiple pressure-generating members arranged spaced apart on the first substrate, can include:

Step 501, Etching the first surface of the first substrate to form a recess.

Figure 18A:
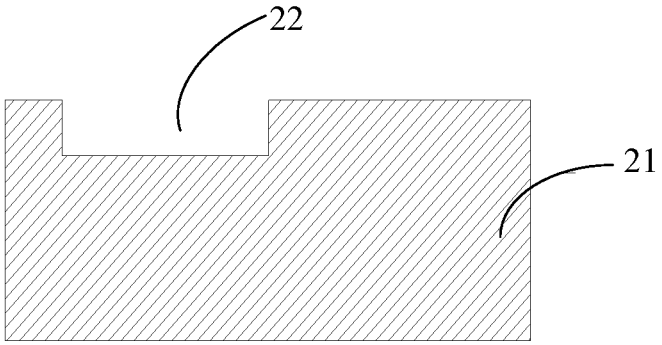
FIG. 18A to FIG. 18G are structural views in a product manufacturing process according to another implementation of the present invention.

As shown in FIG. 18A, in particular, the first surface of the first substrate 21 is etched using dry etching or wet etching to form a recess 22, and the recess 22 is used to accommodate the pressure-generating member.

Step 502, Forming a piezoelectric element within the recess, where an upper surface of the piezoelectric element is flush with the first surface of the first substrate.

Figure 18B:
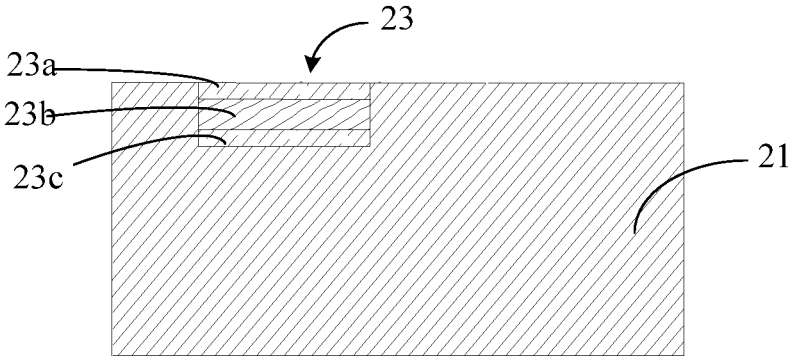

As shown in FIG. 18B, a lower electrode layer 23*c*, a piezoelectric layer 23*b* and an upper electrode layer 23*a* can be formed sequentially by sputtering within the recess 22; particularly, the lower electrode layer 23*c* is a titanium (Ti) layer, a platinum (Pt) layer or a superimposed layer consisting of multiple titanium layers; the piezoelectric layer 23*b* is a lead zirconate titanate (PZT) layer; the upper electrode layer 23*a* is a platinum (Pt) layer or a gold layer.

Step 503, Forming, on the first surface of the first substrate, a vibrating plate covering the external of the piezoelectric element.

Figure 18C:
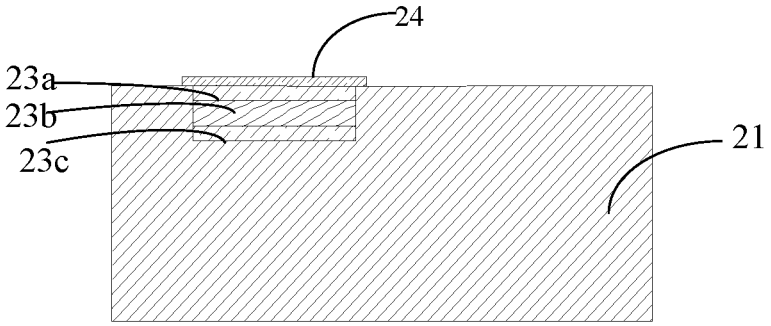

As shown in FIG. 18C, a vibrating plate 24 is formed on the first surface of the first substrate 21 by a low pressure chemical vapor deposition or a plasma enhanced chemical vapor deposition, and the material of the vibrating plate 24 can be SiO2 or Si3N4 or a stack of SiO2-Si3N4; the vibrating plate 24 covers the external of the upper electrode layer 23*a*, and the outer edge is provided over the first surface of the first substrate 21.

Figure 18D:
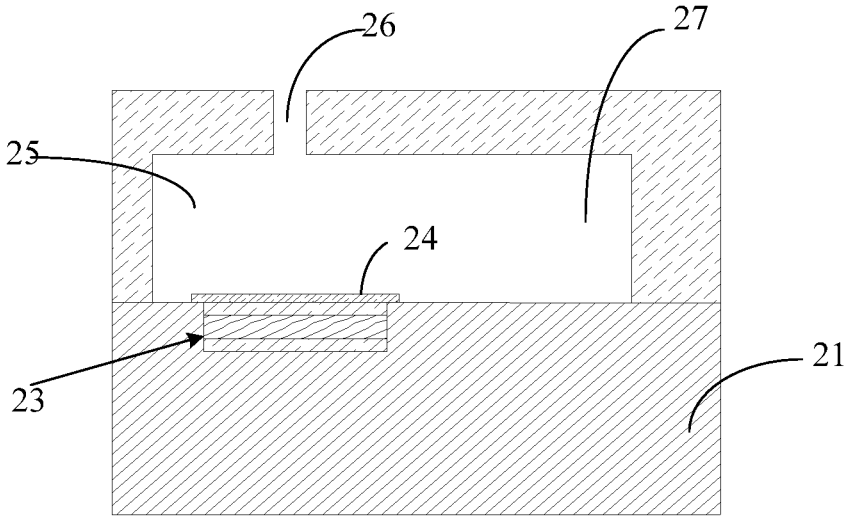

Then, as shown in FIG. 18D, the pressure chambers 25, the common chamber 27 and the jet orifices 26 are formed according to the integrally manufacturing method in the above embodiments; the above chambers and the jet orifice formed by the above method can improve a print resolution and minimize the liquid jet apparatus.

Figure 15:
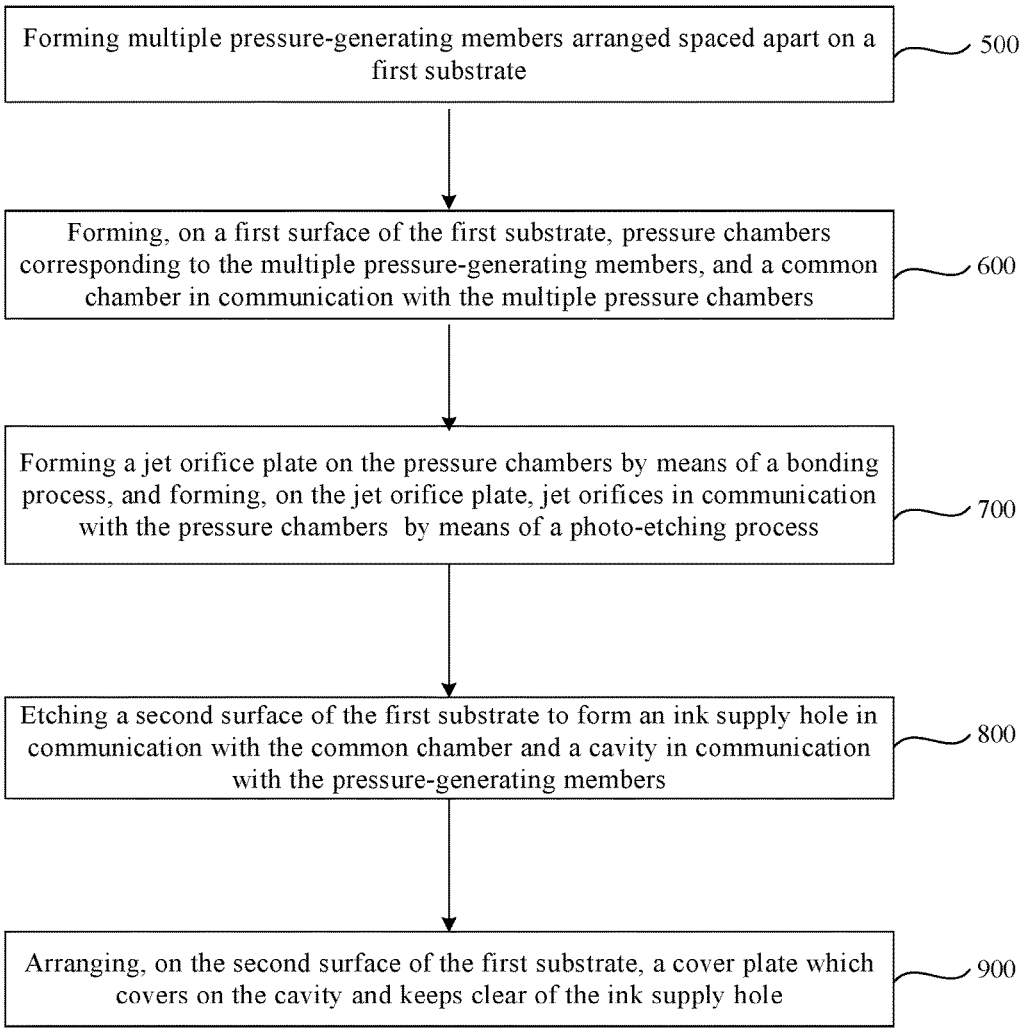
FIG. 15 is a flowchart of a method for integrally manufacturing a liquid jet apparatus according to another embodiment of the present invention.

FIG. 15 is a flowchart of a method for integrally manufacturing a liquid jet apparatus according to another embodiment of the present invention; further, as shown in FIG. 15, after step 700 of the above integrally manufacturing method, the method also can include:

Step 800, Etching a second surface of the first substrate to form an ink supply hole in communication with the common chamber and a cavity in communication with the pressure-generating members.

Figure 18E:
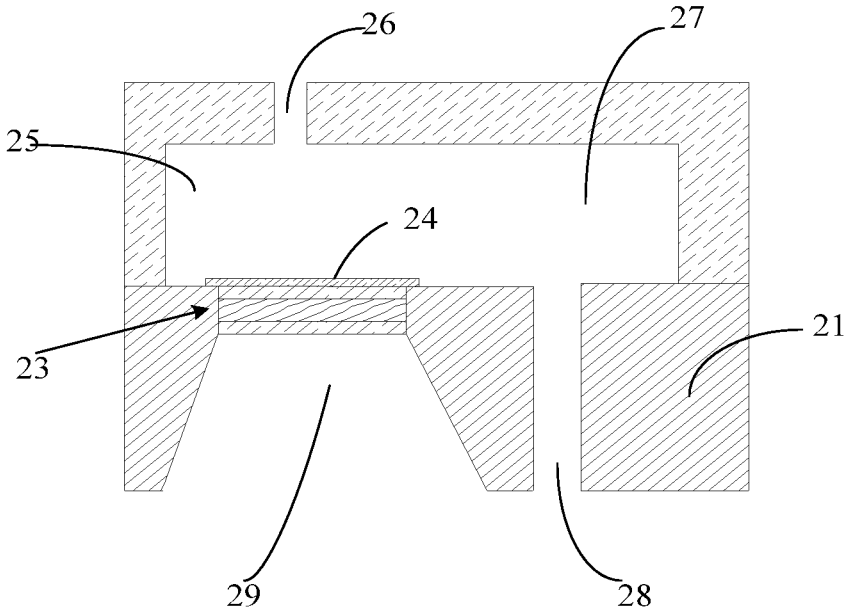

As shown in FIG. 18E, a second surface (a lower surface of the first substrate as shown in the figure) of the first substrate 21 can be etched using dry etching to form an ink supply hole 28 in communication with the common chamber 27 and a cavity 29 in communication with the lower electrode layer 23*c* of the piezoelectric element 23, where, the cavity 29 can increase the vibration amplitude of the piezoelectric element 23.

Figure 18F:
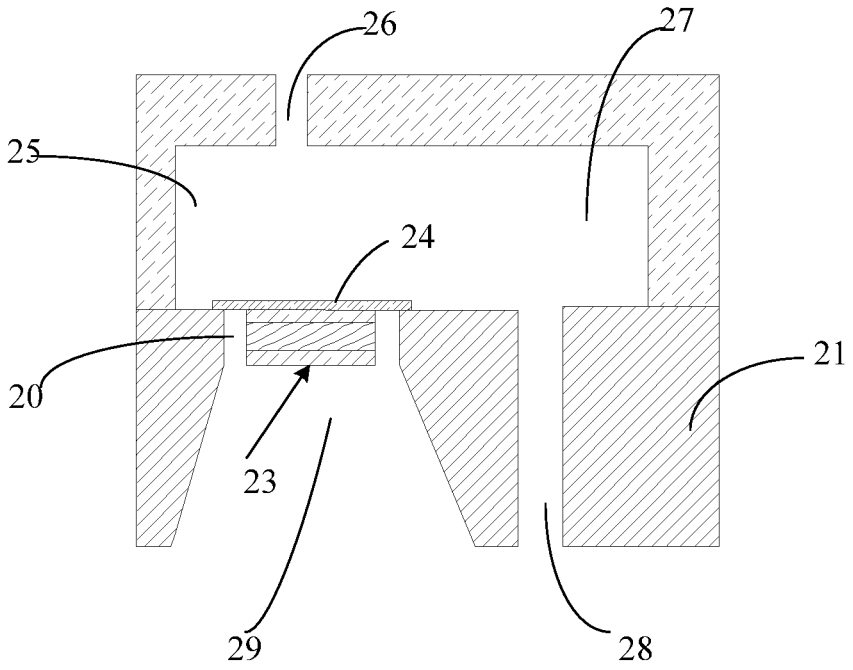

In order to further improve the vibration performance of the piezoelectric element 23, as shown in FIG. 18F, a gap 20 can be formed between both sides of the piezoelectric element 23 and the first substrate 21; the gap 20 can guarantee that the piezoelectric element 23 is not constrained by the first substrate 21 while vibrating, which can improve the vibration amplitude.

Step 900, Arranging, on the second surface of the first substrate, a cover plate which covers on the cavity and keeps clear of the ink supply hole.

Figure 18G:
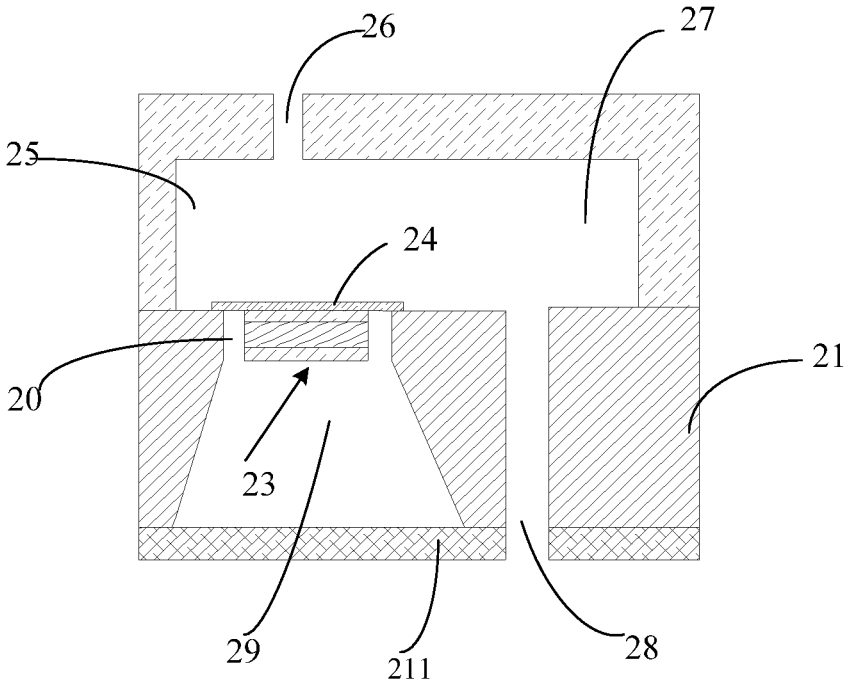

As shown in FIG. 18G, a cover plate 211 is bonded to the second surface of the first substrate 21, to complete the manufacturing process of the liquid jet apparatus, and the material of the cover plate 211 can be polymethyl acrylate (PMMA).

In technical solutions of the above embodiments, step 500, forming multiple pressure-generating members arranged spaced apart on the first substrate, also can be implemented in other modes, particularly, step 500 can include:

Step 501', Forming a vibrating plate on the first surface of the first substrate.

Figure 19A:
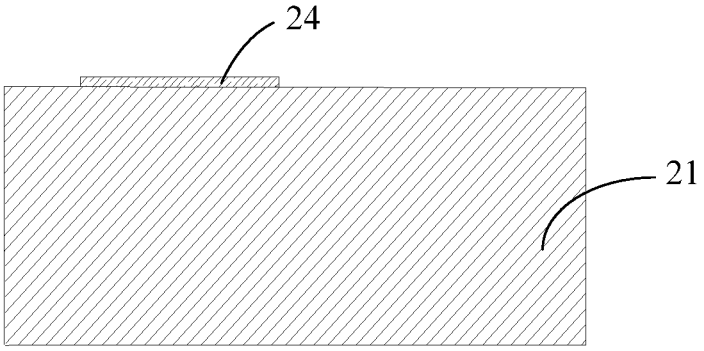
FIG. 19A to FIG. 19C are structural views in a product manufacturing process according to still another implementation of the present invention.

As shown in FIG. 19A, a vibrating plate can be formed on the first surface of the first substrate 21 by a low pressure chemical vapor deposition or a plasma enhanced chemical vapor deposition; the material of the vibrating plate is SiO2 or Si3N4 or a stack of SiO2-Si3N4.

Step 502', Forming a piezoelectric element on the vibrating plate.

Figure 19B:
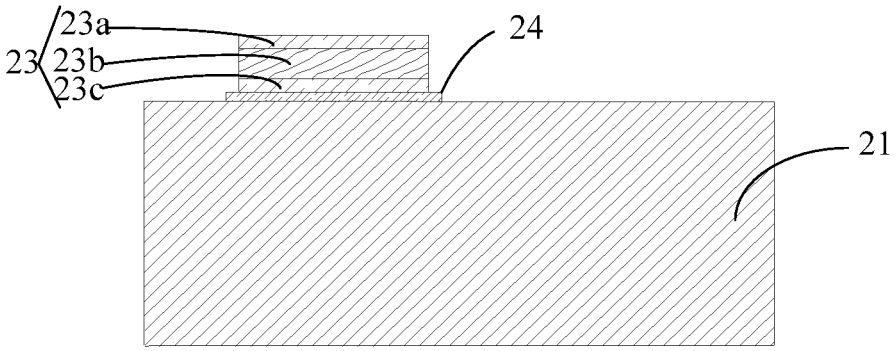

As shown in FIG. 19B, a lower electrode layer 23*c* can be formed by sputtering, a piezoelectric layer 23*b* can be formed with a sol-gel method and an upper electrode layer 23*a* can be formed by sputtering; particularly, the lower electrode layer 23*c* can be a titanium (Ti) layer, a platinum (Pt) layer or a superimposed layer consisting of multiple titanium layers; the piezoelectric layer can be a lead zirconate titanate (PZT) layer; the upper electrode layer can be a platinum (Pt) layer or a gold layer.

Figure 19C:
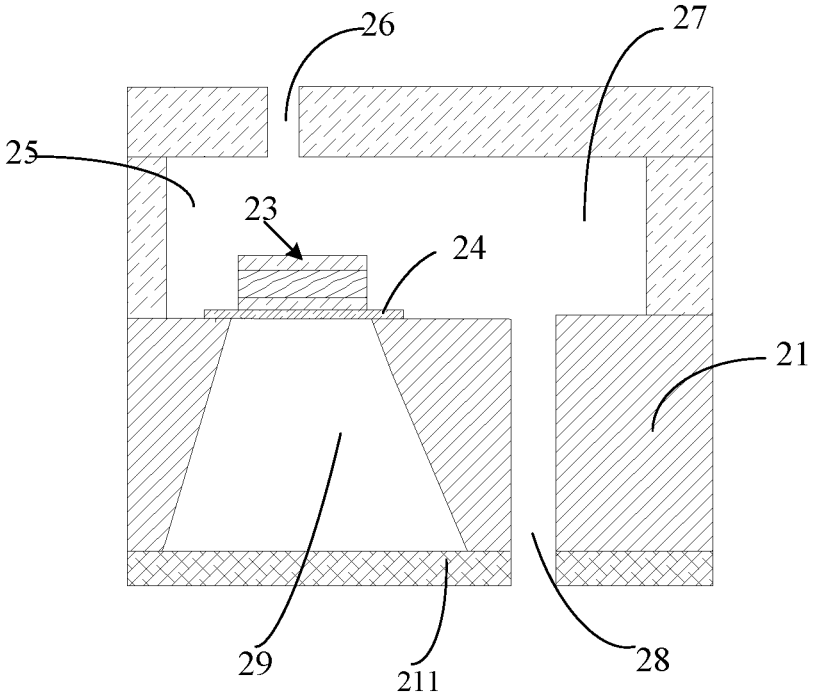

As shown in FIG. 19C, then, the pressure chambers 25, the common chamber 27 and the jet orifices 26 can be formed on the first surface of the first substrate 21 according to the integrally manufacturing method in the above embodiments. The second surface of the first substrate 21 is etched to form the ink supply hole 28 in communication with the common chamber 27 and the cavity 29 in communication with the lower electrode layer 23*c* of the pressure element 23. The cover plate 211 is arranged on the second surface of the first substrate 21, and the cover plate 211 is arranged covering on the cavity 29 and keeping clear of the ink supply hole 28.

Figure 20A:
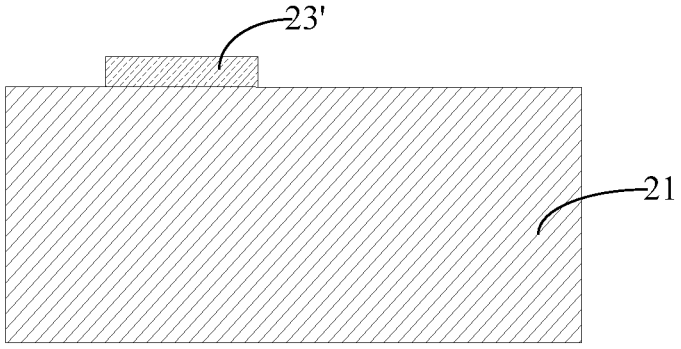
FIG. 20A to FIG. 20B are structural views in a product manufacturing process according to yet another implementation of the present invention.
Figure 20B:
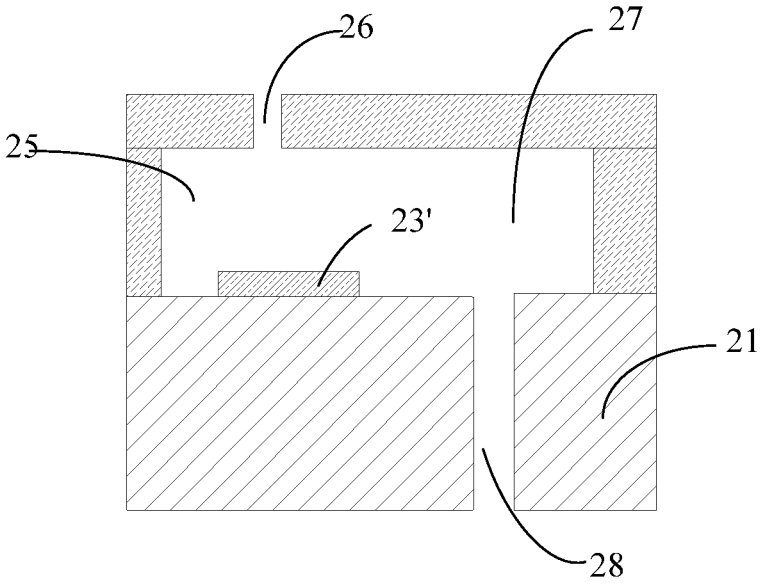

FIG. 20A to FIG. 20B are structural views in a product manufacturing process according to yet another implementation of the present invention. As shown in FIG. 20A, on the basis of technical solutions of the above embodiments, step 500, forming multiple pressure-generating members arranged spaced apart on the first substrate, particularly is:

Depositing a film resistance layer 23' is deposited on the first surface of the first substrate 21, and the material of the film resistance layer 23' is tantalum-aluminum alloy or nickel-chrome alloy or tungsten silicon nitride or titanium nitride.

Further, as shown in FIG. 20B, etching the second surface of the first substrate 21 to form the ink supply hole 28 in communication with the common chamber 27.

The specific liquid jet process of the liquid jet apparatus manufactured by this embodiment is that: the liquid arrives at the common chamber 27 via the ink supply hole 28, and meanwhile, after a pulse signal is applied, the film resistance layer 23' heats the liquid at a speed of 1000° C./μs; the volatile component in the liquid vaporizes to form air bubbles at around 340° C., and the air bubbles expels ink droplets at the original position from the jet orifices 26; the formation of the air bubbles is reversible, when the pulse signal is released, passive cooling will cause the air bubbles to collapse instantaneously, and then, the ink droplets will jet from the jet orifices 26 completely.

The present invention also provides a liquid jet head, manufactured by the liquid jet head manufacturing method provided in the above embodiments. According to the liquid jet head provided in this embodiment, the pressure chambers and the common chamber are formed on the first surface of the first substrate; when the number of pressure chambers of the liquid jet head needs to be increased, since the pressure chambers are formed on the first substrate individually in this embodiment, the mechanical strength of the first substrate will not be reduced, and during the manufacturing process, breakage of the first substrate can be avoided, and thus improving the yield of the liquid jet head, and reducing the manufacturing cost. Moreover, the jet orifice plate is formed by means of the bonding process, and the jet orifices are formed on the jet orifice plate by means of the photo-etching process, thus preventing the adhesive from flowing into the pressure chambers, and improving print quality of the liquid jet head.

The present invention also provides a printing apparatus, including the liquid jet head provided in the above embodiments. Technical solutions of the printing apparatus also have the above effects, and will not be described in detail here.

The present invention also provides a liquid jet apparatus, manufactured by the method for integrally manufacturing the liquid jet apparatus provided in the above embodiments. According to the liquid jet apparatus provided in this embodiment, the pressure chambers and the common chamber are formed on the first surface of the first substrate; when the number of pressure chambers of the liquid jet apparatus needs to be increased, since the pressure chambers are formed on the first substrate individually in this embodiment, the mechanical strength of the first substrate will not be reduced, and during the manufacturing process, breakage of the first substrate can be avoided, and thus improving the yield of the liquid jet apparatus, and reducing the manufacturing cost. Moreover, the jet orifice plate is formed by means of the bonding process, and the jet orifices are formed on the jet orifice plate by means of the photo-etching process, thus preventing the adhesive from flowing into the pressure chambers, and improving print quality of the liquid jet apparatus.

Finally, it should be noted that the above embodiments are merely provided for describing the technical solutions of the present invention, but not intended to limit the present invention. It should be understood by persons skilled in the art that although the present invention has been described in detail with reference to the foregoing embodiments, modifications can be made to the technical solutions described in the foregoing embodiments, or equivalent replacements can be made to part or all of technical features in the technical solutions; however, such modifications or replacements do not cause the essence of corresponding technical solutions to depart from the scope of the embodiments of the present invention.

What is claimed is:

1. A liquid jet head manufacturing method, comprising:

forming multiple pressure-generating members arranged spaced apart on a first substrate;

forming, on a first surface of the first substrate, pressure chambers corresponding to the multiple pressure-generating members, and a common chamber in communication with the multiple pressure chambers;

forming a transition layer on the pressure chambers by means of a bonding process, and forming a jet orifice plate on the transition layer; and forming, on the jet orifice plate and the transition layer, jet orifices in communication with the pressure chambers by means of a photo-etching process.

2. The liquid jet head manufacturing method according to claim 1, wherein, the forming, on the first surface of the first substrate, the pressure chambers corresponding to the multiple pressure-generating members, and the common chamber in communication with the multiple pressure chambers, comprises:

arranging and exposing a chamber layer on the first surface of the first substrate, and defining a shape and a position of the pressure chambers and the common chamber;

developing to form the pressure chambers and the common chamber.

3. The liquid jet head manufacturing method according to claim 2, wherein, the forming the transition layer on the pressure chambers by means of the bonding process, and forming the jet orifice plate on the transition layer, comprises:

applying in a spin way the transition layer on a second substrate;

bonding a chamber wall of the chamber layer and the transition layer together by means of a bonding process;

stripping the second substrate;

applying in a spin way the jet orifice plate on the transition layer.

4. The liquid jet head manufacturing method according to claim 3, materials of the transition layer and the chamber layer are negative photosensitive adhesive SU8 or polyimide with a good machining property.

5. The liquid jet head manufacturing method according to claim 1, wherein, the forming multiple pressure-generating members arranged spaced apart on the first substrate, comprises:

etching the first surface of the first substrate to form a recess;

forming a piezoelectric element within the recess, wherein an upper surface of the piezoelectric element is flush with the first surface of the first substrate;

forming, on the first surface of the first substrate, a vibrating plate covering an external of the piezoelectric element.

6. The liquid jet head manufacturing method according to claim 5, wherein, the forming the piezoelectric element within the recess, comprises:

forming a lower electrode layer, a piezoelectric layer and an upper electrode layer sequentially by sputtering within the recess; wherein, the lower electrode layer is a titanium layer, a platinum layer or a superimposed layer consisting of multiple titanium layers; the piezoelectric layer is a lead zirconate titanate layer; the upper electrode layer is a platinum layer or a gold layer.

7. The liquid jet head manufacturing method according to claim 6, wherein, after forming, on the jet orifice plate and the transition layer, jet orifices in communication with the pressure chambers by means of the photo-etching process, the method further comprises:

etching a second surface of the first substrate to form an ink supply hole in communication with the common chamber and a cavity in communication with the pressure-generating members;

arranging, on the second surface of the first substrate, a cover plate which covers on the cavity and keeps clear of the ink supply hole.

8. The liquid jet head manufacturing method according to claim 7, wherein, after etching the second surface of the first substrate to form the ink supply hole in communication with the common chamber and the cavity in communication with the pressure-generating members, the method further comprises:

forming a gap between both sides of the piezoelectric element and the first substrate.

9. The liquid jet head manufacturing method according to claim 1, wherein, the forming multiple pressure-generating members arranged spaced apart on the first substrate, comprises:

forming a vibrating plate on the first surface of the first substrate;

forming a piezoelectric element on the vibrating plate.

10. The liquid jet head manufacturing method according to claim 9, wherein, after forming, on the jet orifice plate and the transition layer, jet orifices in communication with the pressure chambers by means of the photo-etching process, the method further comprises:

etching a second surface of the first substrate to form an ink supply hole in communication with the common chamber and a cavity in communication with the pressure-generating members;

arranging, on the second surface of the first substrate, a cover plate which covers on the cavity and keeps clear of the ink supply hole.

11. The liquid jet head manufacturing method according to claim 1, wherein, the forming multiple pressure-generating members arranged spaced apart on the first substrate, comprises:

depositing a film resistance layer on the first surface of the first substrate, wherein, a material of the film resistance layer is tantalum-aluminum alloy or nickel-chrome alloy or tungsten silicon nitride or titanium nitride.

12. The liquid jet head manufacturing method according to claim 11, wherein, after forming, on the jet orifice plate and the transition layer, jet orifices in communication with the pressure chambers by means of the photo-etching process, the method further comprises:

etching a second surface of the first substrate to form an ink supply hole in communication with the common chamber.

* * * * *